US009435033B2

(12) United States Patent
Qu et al.

(10) Patent No.: US 9,435,033 B2
(45) Date of Patent: Sep. 6, 2016

(54) CORROSION PREVENTION OF MAGNESIUM SURFACES VIA SURFACE CONVERSION TREATMENTS USING IONIC LIQUIDS

(71) Applicant: UT-Battelle, LLC, Oak Ridge, TN (US)

(72) Inventors: Jun Qu, Oak Ridge, TN (US); Huimin Luo, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 322 days.

(21) Appl. No.: 14/044,248

(22) Filed: Oct. 2, 2013

(65) Prior Publication Data

US 2015/0090369 A1 Apr. 2, 2015

(51) Int. Cl.

| | |
|---|---|
| ***C23C 22/48*** | (2006.01) |
| ***C23C 22/57*** | (2006.01) |
| ***C23C 22/03*** | (2006.01) |
| ***C23C 22/74*** | (2006.01) |
| *C23C 22/00* | (2006.01) |

(52) U.S. Cl.

CPC ..... *C23C 22/03* (2013.01); *C23C 22/48* (2013.01); *C23C 22/57* (2013.01); *C23C 22/74* (2013.01)

(58) Field of Classification Search

CPC ..... C23C 22/48

See application file for complete search history.

(56) References Cited

PUBLICATIONS

Petro et al. "Ionic Liquid Treatments for Enhanced Corrosion Resistance of Magnesium-Based Substrates", Modern Electroplating, Fifth Edition, Copyright © 2010, John Wiley & Sons, Inc.*

Howlett et al. "Conversion coatings of Mg-alloy AZ91D using trihexyl(tetradecyl) phosphonium bis(trifluoromethanesulfonyl)amide ionic liquid", Science China, Chemistry, vol. 55 No. 8:1598-1607, Aug. 2012.*

Birbilis N. et al., "Exploring Corrosion Protection of Mg Via Ionic Liquid Pretreatment", Surface & Coatings Technology 201:4496-4504 (2007).

Efthimiadis J. et al., "Potentiostatic Control of Ionic Liquid Surface Film Formation on ZE41 Magnesium Alloy", ACS Applied Materials & Interfaces 2(5):1317-1323 (2010).

Forsyth M. et al., "An Ionic Liquid Surface Treatment for Corrosion Protection of Magnesium Alloy AZ31", Electrochemical and Solid-State Letters 9(11):B52-B55 (2006).

Forsyth M. et al., "New Insights into the Fundamental Chemical Nature of Ionic Liquid Film Formation on Magnesium Alloy Surfaces", ASC Applied Materials & Interfaces 1(5):1045-1052 (2009).

Howlett P.C. et al., "Characterization of the Magnesium Alloy AZ31 Surface in the Ionic Liquid Trihexyl(Tetradecyl) Phosphonium Bis(Trifluoromethanesulfonyl)Amide", Journal of the Electrochemical Society 157(11):C392-C398 (2010).

(Continued)

*Primary Examiner* — Lois Zheng

(74) *Attorney, Agent, or Firm* — Scully Scott Murphy & Presser

(57) ABSTRACT

A method for conversion coating a magnesium-containing surface, the method comprising contacting the magnesium-containing surface with an ionic liquid compound under conditions that result in decomposition of the ionic liquid compound to produce a conversion coated magnesium-containing surface having a substantially improved corrosion resistance relative to the magnesium-containing surface before said conversion coating. Also described are the resulting conversion-coated magnesium-containing surface, as well as mechanical components and devices containing the conversion-coated magnesium-containing surface.

32 Claims, 10 Drawing Sheets

(1A) (1B) (1C)

(56) References Cited

PUBLICATIONS

Howlett P.C. et al., "The Effect of Potential Bias on the Formation of Ionic Liquid Generated Surface Films on Mg Alloys", Electrochimica Acta 55:2377-2383 (2010).

Howlett P.C. et al., "An Investigation of a Phosphinate-Based Ionic Liquid for Corrosion Protection of Magnesium Alloy AZ31", Aust. J. Chem. 60:43-46 (2007).

Latham J-A et al., "Electrochemical Reactivity of Trihexyl(Tetradecyl)Phosphonium Bis(2,4,4-Trimethylpentyl) Phosphinate Ionic Liquid on Glassy Carbon and AZ31 Magnesium Alloy", Electrochimica Acta 56:5328-5334 (2011).

Qu J. et al., "Ionic Liquids as Novel Lubricants and Additives for Diesel Engine Applications", Tribol Lett 35:181-189 (2009).

Qu J. et al., "Nanostructure and Composition of Tribo-Boundary Films Formed in Ionic Liquid Lubrication", Tribol Lett 43:205-211 (2011).

Qu J. et al., "Antiwear Performance and Mechanism of an Oil-Miscible Ionic Liquid as a Lubricant Additive", ACS Applied Materials & Interfaces 4:997-1002 (2012).

Qu J. et al., "Tribological Characteristics of Aluminum Alloys Sliding Against Steel Lubricated by Ammonium and Imidazolium Ionic Liquids", Wear 267:1226-1231 (2009).

Sun J. et al., "Synthesis and Physical Property Characterization of Phosphonium Ionic Liquids Based on P(O)2(OR)2-and P(O)2(R)2-Anions With Potential Application for Corrosion Mitigation of Magnesium Alloys", Electrochimica Acta 54:254-260 (2008).

Tindale J.J. et al., "Highly Fluorinated Phosphonium Ionic Liquids: Novel Media for the Generation of Superhydrophobic Coatings", Chem. Commun. 1831-1833 (2009).

* cited by examiner (1A) (1B) (1C)

(2A) (2B)

(5A)

(5B)

(9A)

(9B)

(10A)

(10B)

CORROSION PREVENTION OF MAGNESIUM SURFACES VIA SURFACE CONVERSION TREATMENTS USING IONIC LIQUIDS

This invention was made with government support under Prime Contract No. DE-AC05-00OR22725 awarded by the U.S. Department of Energy. The government has certain rights in the invention.

FIELD OF THE INVENTION

The present invention relates generally to the field of conversion coating of metals, and more particularly, to conversion coating of magnesium and its alloys.

BACKGROUND OF THE INVENTION

Particularly by virtue of their light weight, high strength-to-weight ratio, and good recyclability, magnesium-based alloys are promising candidates for many engineering applications, including automotive applications. Indeed, there is substantial interest in replacing steel and aluminum parts in machinery and transportation vehicles with magnesium alloys. However, the corrosion susceptibility of magnesium alloys remains a particular issue of significant concern. Magnesium alloys are susceptible to corrosion because of their high reactivity and low electrode potential ($E_0$=2.37 V), which prevents them from widespread applications. The corrosion mechanisms of magnesium alloys have been well-studied, and can generally include galvanic corrosion, intergranular corrosion, stress corrosion cracking, and/or corrosion fatigue.

Various types of treatments have been used for protecting magnesium surfaces, such as laser and ion beams, PVD, CVD, chemical conversion, anodization, electro- or electroless plating, organic coating, and others. Among them, chemical conversion coatings are commonly used as paint bases and in some cases as stand-alone protection against atmospheric tarnishing. Traditional conversion coatings are based on hexavalent chromium compounds, but these are associated with severe environmental risks. Some chromate-free conversion coatings have been studied, such as stannate, cerium, aluminum, zirconium, niobium, zinc phosphate, or phosphate permanganate coatings. However, current conversion coating technologies of the art are generally incapable of providing sufficiently passivated magnesium alloys suitable for use in critical applications, such as machinery and automobiles, where mechanical resilience and high wear-resistance are necessary.

SUMMARY OF THE INVENTION

In one aspect, the instant invention is directed to an improved method for conversion coating a magnesium-containing surface. The method generally involves contacting the magnesium-containing surface with an ionic liquid compound (i.e., "ionic liquid") under conditions that result in decomposition of the ionic liquid to produce a conversion coated magnesium-containing surface. Unexpectedly, it has herein been found that exposing a magnesium-containing surface to an ionic liquid under decomposing conditions results in a magnesium-containing surface having a significantly improved corrosion resistance relative to the magnesium-containing surface before the instant conversion coating process. Moreover, the advantages of using an ionic liquid in place of conventional conversion chemicals are numerous. For example, ionic liquids are generally known to possess low volatility, high thermal and electrochemical stability, low flammability, and low toxicity. Compared with conventional conversion chemistry, ionic liquids also provide higher flexibility in molecular design.

The ionic liquid can have any suitable cationic component, particularly a nitrogen-containing cation, such as a nitrogen-containing heterocycle (e.g., imidazolium, pyridinium, piperidinium, pyrazolium, pyrrolium, piperazinium, etc.), or ammonium species. In more specific embodiments, the cationic component of the ionic liquid has the following formula:

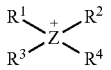

(1)

In Formula (1), Z is either N or P, and $R^1$, $R^2$, $R^3$, and $R^4$ are each independently selected from hydrogen atom and hydrocarbon groups (R) having at least one and up to twenty carbon atoms and optionally substituted with one or more heteroatoms selected from fluorine, nitrogen, oxygen, and sulfur, as described below for hydrocarbon groups R, provided that at least one of $R^1$, $R^2$, $R^3$, and $R^4$ is a hydrocarbon group R when Z is N, and provided that $R^1$, $R^2$, $R^3$, and $R^4$ are all hydrocarbon groups when Z is P.

In particular embodiments of Formula (1), the cationic component of the ionic liquid has any of the following formulas:

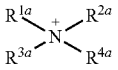

(1a)

or

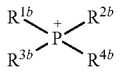

(1b)

In the above formulas, $R^{1a}$, $R^{2a}$, $R^{3a}$, and $R^{4a}$ are each independently selected from hydrogen atom and hydrocarbon groups having at least one and up to twenty carbon atoms, wherein the hydrocarbon groups are optionally substituted with one or more fluorine atoms, provided that at least one of $R^{1a}$, $R^{2a}$, $R^{3a}$, and $R^{4a}$ is a hydrocarbon group; and $R^{1b}$, $R^{2b}$, $R^{3b}$, and $R^{4b}$ are independently selected from hydrocarbon groups having at least one and up to twenty carbon atoms, wherein the hydrocarbon groups are optionally substituted with one or more fluorine atoms.

The ionic liquid compound can have any suitable anionic component, and particularly, a phosphorus-containing anion. In particular embodiments, the anionic component of the ionic liquid has a phosphorus-containing anion of the formula:

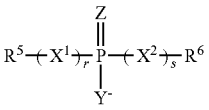

(2)

In Formula (2), $R^5$ and $R^6$ are independently selected from hydrocarbon groups having at least one and up to twenty carbon atoms, wherein the hydrocarbon groups are optionally substituted with one or more fluorine atoms, and $R^5$ and $R^6$ may optionally interconnect to form a ring; $X^1$, $X^2$, Y and Z are independently selected from O and S atoms; and subscripts r and s are independently selected from 0 and 1. Thus, Formula (2) includes organophosphates, organophosphonates, organophosphinates, and mono-, di-, tri-, and tetra-thio derivatives of any of the foregoing sub-classes under Formula (2).

In particular embodiments, the ionic liquid compound has the general formula:

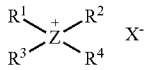

In the above formula, Z, $R^1$, $R^2$, $R^3$, and $R^4$ are as described above, and X" is an anionic component of the ionic liquid. The anionic component X" can be any anion, and more particularly, a phosphorus-containing anion, such as an anion encompassed by Formula (2) above.

In another aspect, the invention is directed to a magnesium-containing material that has been treated by the above-described conversion coating process. The treated magnesium-containing material surprisingly exhibits a significantly improved corrosion resistance relative to the magnesium-containing surface before the instant conversion coating process, and even a significantly improved corrosion resistance relative to the same magnesium-containing surface coated with the same ionic liquid but under conditions where the ionic liquid has not decomposed. The improved corrosion resistance may be evidenced in a remarkable substantial absence of corrosion even after rigorous corrosion tests, such as being treated in a salt solution of at least 0.1 M concentration for several hours.

In yet another aspect, the invention is directed to a mechanical component or device containing the conversion-coated magnesium-containing surface described above. The mechanical component or device is typically directed to an application in which mechanical resilience, corrosion resistance, and high wear-resistance are all required.

DETAILED DESCRIPTION OF THE INVENTION

Figures 1A, 1B, 1C:
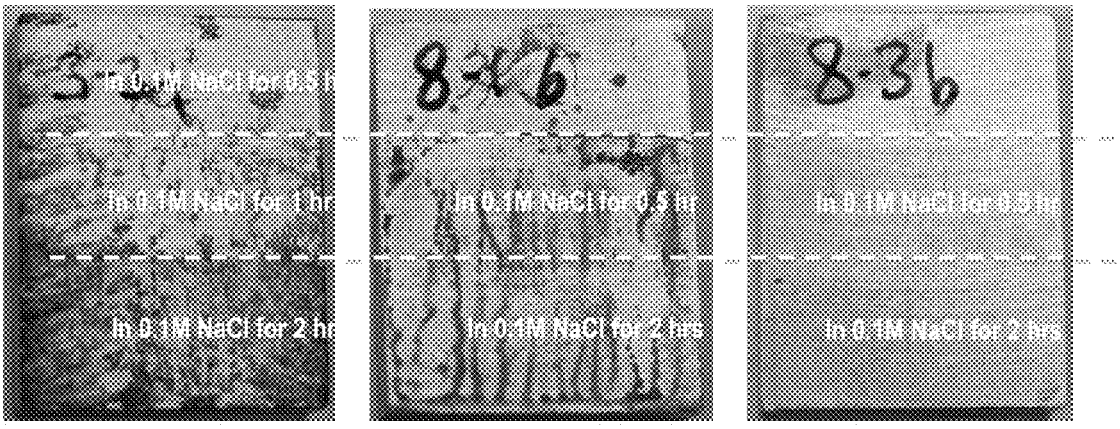
FIGS. 1A-1C. Photographs of Mg AZ31B blocks, with and without a thermoconversion treatment using the ionic liquid tetraoctylammonium di(2-ethylhexyl)phosphate ([N8888][DEHP]), after immersion in a 0.1 M NaCl solution for up to 2 hours. Mg AZ31B surface that is untreated is shown in FIG. 1A; Mg AZ31B surface treated by the ionic liquid overnight at room temperature is shown in FIG. 1B; and Mg AZ31B surface treated by the ionic liquid at a decomposing temperature of 250° C. for the ionic liquid is shown in FIG. 1C.

As used herein, the term "about" generally indicates within ±0.5%, 1%, 2%, 5%, or up to ±10% of the indicated value. For example, the term "about 100° C." generally indicates, in its broadest sense, 100° C.±10%, which indicates 90-110° C. The term "about" may alternatively indicate a variation or average in a physical characteristic of a group.

The term "hydrocarbon group" or "hydrocarbon linker" (also identified as "R"), as used herein, designates, in a first embodiment, groups or linkers composed solely of carbon and hydrogen. In different embodiments, one or more of the hydrocarbon groups or linkers can contain precisely, or a minimum of, or a maximum of, for example, one, two, three, four, five, six, seven, eight, nine, ten, eleven, or twelve carbon atoms, or a number of carbon atoms within a particular range bounded by any two of the foregoing carbon numbers. In some embodiments, the hydrocarbon group may include up to 20 or more carbon atoms. Hydrocarbon groups or linkers in different compounds described herein, or in different positions of a compound, may possess the same or different number (or preferred range thereof) of carbon atoms in order to independently adjust or optimize the activity or other characteristics of the compound.

The hydrocarbon groups or linkers (R) can be, for example, saturated and straight-chained (i.e., straight-chained alkyl groups or alkylene linkers). Some examples of straight-chained alkyl groups (or alkylene linkers) include methyl (or methylene linker, i.e., —$CH_2$—, or methine linker), ethyl (or ethylene or dimethylene linker, i.e., —$CH_2CH_2$— linker), n-propyl, n-butyl, n-pentyl, n-hexyl, n-heptyl, n-octyl, n-nonyl, n-decyl, n-undecyl, and n-dodecyl groups (or their respective linker analogs).

The hydrocarbon groups or linkers (R) can alternatively be saturated and branched (i.e., branched alkyl groups or alkylene linkers). Some examples of branched alkyl groups include isopropyl(2-propyl), isobutyl(2-methylprop-1-yl), sec-butyl(2-butyl), t-butyl, 2-pentyl, 3-pentyl, 2-methylbut-1-yl, isopentyl(3-methylbut-1-yl), 1,2-dimethylprop-1-yl, 1,1-dimethylprop-1-yl, neopentyl(2,2-dimethylprop-1-yl), 2-hexyl, 3-hexyl, 2-methylpent-1-yl, 3-methylpent-1-yl, isohexyl (4-methylpent-1-yl), 1,1-dimethylbut-1-yl, 1,2-dimethylbut-1-yl, 2,2-dimethylbut-1-yl, 2,3-dimethylbut-1-yl, 3,3-dimethylbut-1-yl, 1,1,2-trimethylprop-1-yl, and 1,2,2-trimethylprop-1-yl groups, wherein the "1-yl" suffix represents the point of attachment of the group. Some examples of branched alkylene linkers are those derived by removal of a hydrogen atom from one of the foregoing exemplary branched alkyl groups (e.g., isopropylene, —$CH(CH_3)CH_2$—).

The hydrocarbon groups or linkers (R) can alternatively be saturated and cyclic (i.e., cycloalkyl groups or cycloalkylene linkers). Some examples of cycloalkyl groups include cyclopropyl, cyclobutyl, cyclopentyl, cyclohexyl, cycloheptyl, and cyclooctyl groups. The cycloalkyl group can also be a polycyclic (e.g., bicyclic) group by either possessing a bond between two ring groups (e.g., dicyclohexyl) or a shared (i.e., fused) side (e.g., decalin and norbornane). Some examples of cycloalkylene linkers are those derived by removal of a hydrogen atom from one of the foregoing exemplary cycloalkyl groups.

The hydrocarbon groups or linkers (R) can alternatively be unsaturated and straight-chained (i.e., straight-chained olefinic or alkenyl groups or linkers). The unsaturation occurs by the presence of one or more carbon-carbon double bonds and/or one or more carbon-carbon triple bonds. Some examples of straight-chained olefinic groups include vinyl, propen-1-yl (allyl), 3-buten-1-yl ($CH_2$=CH—$CH_2$—$CH_2$—), 2-buten-1-yl ($CH_2$—CH=CH—$CH_2$—), butadienyl, 4-penten-1-yl, 3-penten-1-yl, 2-penten-1-yl, 2,4-pentadien-1-yl, 5-hexen-1-yl, 4-hexen-1-yl, 3-hexen-1-yl, 3,5-hexadien-1-yl, 1,3,5-hexatrien-1-yl, 6-hepten-1-yl, ethynyl, and propargyl (2-propynyl). Some examples of straight-chained olefinic linkers are those derived by removal of a hydrogen atom from one of the foregoing exemplary straight-chained olefinic groups (e.g., vinylene, —CH=CH—, or vinylidene).

The hydrocarbon groups or linkers (R) can alternatively be unsaturated and branched (i.e., branched olefinic or alkenyl groups or linkers). Some examples of branched olefinic groups include propen-2-yl ($CH_2$=C.—$CH_3$), 1-buten-2-yl ($CH_2$=C.—$CH_2$—$CH_3$), 1-buten-3-yl ($CH_2$=CH—CH.—$CH_3$), 1-propen-2-methyl-3-yl ($CH_2$=C($CH_3$)—$CH_2$.), 1-penten-4-yl, 1-penten-3-yl, 1-penten-2-yl, 2-penten-2-yl, 2-penten-3-yl, 2-penten-4-yl, and 1,4-pentadien-3-yl. Some examples of branched olefinic linkers are those derived by removal of a hydrogen atom from one of the foregoing exemplary branched olefinic groups.

The hydrocarbon groups or linkers (R) can alternatively be unsaturated and cyclic (i.e., cycloalkenyl groups or cycloalkenylene linkers). The unsaturated and cyclic group can be aromatic or aliphatic. Some examples of unsaturated and cyclic hydrocarbon groups include cyclopropenyl, cyclobutenyl, cyclopentenyl, cyclopentadienyl, cyclohexenyl, cyclohexadienyl, phenyl, benzyl, cycloheptenyl, cycloheptadienyl, cyclooctenyl, cyclooctadienyl, and cyclooctatetraenyl groups. The unsaturated cyclic hydrocarbon group can also be a polycyclic group (such as a bicyclic or tricyclic polyaromatic group) by either possessing a bond between two of the ring groups (e.g., biphenyl) or a shared (i.e., fused) side, as in naphthalene, anthracene, phenanthrene, phenalene, or indene. Some examples of unsaturated cycloalkenylene linkers are those derived by removal of a hydrogen atom from one of the foregoing exemplary cycloalkenyl groups (e.g., phenylene and biphenylene).

One or more of the hydrocarbon groups or linkers (R) may (i.e., optionally) be substituted with (i.e., include) one or more heteroatoms, which are non-carbon non-hydrogen atoms. Some examples of heteroatoms include oxygen (O), nitrogen (N), sulfur (S), and halogen (halide) atoms. Some examples of halogen atoms include fluorine, chlorine, bromine, and iodine. In some embodiments, the heteroatom atom inserts between at least two carbon atoms (as in —C—O—C— ether, —C—N(R)—C— tertiary amine, or —C(=NR)C— imine) or between at least one carbon atom and at least one hydrogen atom (as in —C—OH, —C—SH, —C—$NH_2$, —C—NH—C—, or —C(=NH)C—), wherein the shown carbon atom in each case can be considered part of a hydrocarbon group R described above. In other embodiments, the heteroatom replaces one or more hydrogen atoms and/or one or more carbon atoms in the hydrocarbon group, as in halogen-substituted groups (e.g., a —$CH_2F$, —$CHF_2$, and —$CF_3$) and carbonyl-substituted groups, such as ketone and aldehyde groups. In the case of nitrogen or sulfur substitution, the nitrogen or sulfur atom may be bonded to a sufficient number of groups to make it positively charged, as in an ammonium group (e.g., —$NR'_3^+$) or sulfonium group (e.g., —$SR'_2^+$), in which case the positively charged moiety is necessarily associated with a counteranion (wherein R' independently represents hydrogen atom or any of the hydrocarbon groups described above). Likewise, a heteroatom may bear a negative charge, as in a deprotonated alkoxide or thio group, in which case the negatively charged moiety is necessarily associated with a countercation.

When two or more same or different heteroatoms are bound to each other or located on the same carbon atom, the resulting group containing the heteroatoms is herein referred to as a "heteroatom-containing group". Thus, substitution with one or more heteroatoms also includes heteroatom-containing groups, unless otherwise specified. Some examples of heteroatom-containing groups and linkers include carboxy (—C(O)OR' or —OC(O)R'), carboxamide (—C(O)$NR'_2$, —C(O)NR'—, or —N(R')C(O)—), urea (—NR'—C(O)—NR'$_2$ or —NR'—C(O)—NR'—), carbamate (—NR'—C(O)—OR', —OC(O)—NR'$_2$, or —NR'—C(O)—O—), nitro ($NO_2$), nitrile (CN), sulfonyl (—S(O)$_2$R' or —S(O)$_2$—), sulfinyl (i.e., sulfoxide, —S(O)R' or —S(O)—), disulfide (—C—S—S—C—), sulfonate (—S(O)$_2$R'), and amine oxide (as typically found in a nitrogen-containing ring), wherein R' independently represents hydrogen atom or any of the hydrocarbon groups (R) described above. For example, —C(O)OR' includes carboxylic acid (—C(O)OH) and carboxylic ester (—C(O)OR), where R is any of the hydrocarbon groups described above. The heteroatom-containing group may also either insert between carbon atoms or between a carbon atom and hydrogen atom, if applicable, or replace one or more hydrogen and/or carbon atoms.

In some embodiments, the hydrocarbon group or linker (R) is substituted with one or more halogen atoms to result in a partially halogenated or perhalogenated hydrocarbon group. Some examples of partially halogenated hydrocarbon groups include —CHY$_2$, —CH$_2$Y, —CH$_2$CY$_3$, —CH(CY$_3$)$_2$, or a halo-, dihalo-, trihalo-, or tetrahalo-substituted phenyl group, wherein Y represents any of F, Cl, Br, or I, and more commonly, F or Cl. Some examples of perhalogenated hydrocarbon groups include —CY$_3$, —CY$_2$CY$_3$, —CY$_2$CY$_2$CY$_3$, —CY(CY$_3$)$_2$, or perhalophenyl, —C$_6$Y$_5$.

When the hydrocarbon group is or includes a cyclic or polycyclic (i.e., bicyclic, tricyclic, or higher cyclic) group, the cyclic hydrocarbon group can be carbocyclic or heterocyclic. A carbocyclic group is a saturated or unsaturated cyclic or polycyclic hydrocarbon group that does not contain ring heteroatoms (i.e., it contains only ring carbon atoms). A heterocyclic group is a cyclic or polycyclic hydrocarbon group that includes at least one ring heteroatom (for example, one, two, three, four, or higher number of heteroatoms). As used herein, a "ring heteroatom" is an atom other than carbon and hydrogen (typically, selected from nitrogen, oxygen, and sulfur) that is inserted into, or replaces a ring carbon atom in, a hydrocarbon ring structure. In some embodiments, the heterocyclic group is saturated, while in other embodiments, the heterocyclic group is unsaturated (i.e., aliphatic or aromatic heterocyclic groups, wherein the aromatic heterocyclic group is also referred to herein as a "heteroaromatic ring", or a "heteroaromatic fused-ring system" in the case of at least two fused rings, at least one of which contains at least one ring heteroatom). In some embodiments, the heterocyclic group is bound via one of its ring carbon atoms to another group (i.e., other than hydrogen atom and adjacent ring atoms), while the one or more ring heteroatoms are not bound to another group. In other embodiments, the heterocyclic group is bound via one of its heteroatoms to another group, while ring carbon atoms may or may not be bound to another group.

Some examples of saturated heterocyclic groups containing at least one oxygen atom include oxetane, tetrahydrofuran, tetrahydropyran, 1,4-dioxane, 1,3-dioxane, and 1,3-dioxepane rings. Some examples of saturated heterocyclic groups containing at least one nitrogen atom include pyrrolidine, piperidine, piperazine, imidazolidine, azepane, and decahydroquinoline rings. Some examples of saturated heterocyclic groups containing at least one sulfur atom include tetrahydrothiophene, tetrahydrothiopyran, 1,4-dithiane, 1,3-dithiane, and 1,3-dithiolane rings. Some examples of saturated heterocyclic groups containing at least one oxygen atom and at least one nitrogen atom include morpholine and oxazolidine rings. An example of a saturated heterocyclic group containing at least one oxygen atom and at least one sulfur atom includes 1,4-thioxane. Some examples of saturated heterocyclic groups containing at least one nitrogen atom and at least one sulfur atom include thiazolidine and thiamorpholine rings.

Some examples of unsaturated heterocyclic groups containing at least one oxygen atom include furan, pyran, 1,4-dioxin, benzofuran, dibenzofuran, and dibenzodioxin rings. Some examples of unsaturated heterocyclic groups containing at least one nitrogen atom include pyrrole, imidazole, pyrazole, pyridine, pyrazine, pyrimidine, 1,3,5-triazine, azepine, diazepine, indole, purine, benzimidazole, indazole, 2,2'-bipyridine, quinoline, isoquinoline, phenanthroline, 1,4,5,6-tetrahydropyrimidine, 1,2,3,6-tetrahydropyridine, 1,2,3,4-tetrahydroquinoline, quinoxaline, quinazoline, pyridazine, cinnoline, 5,6,7,8-tetrahydroquinoxaline, 1,8-naphthyridine, and 4-azabenzimidazole rings. Some examples of unsaturated heterocyclic groups containing at least one sulfur atom include thiophene, thianaphthene, and benzothiophene rings. Some examples of unsaturated heterocyclic groups containing at least one oxygen atom and at least one nitrogen atom include oxazole, isoxazole, benzoxazole, benzisoxazole, oxazoline, 1,2,5-oxadiazole (furazan), and 1,3,4-oxadiazole rings. Some examples of unsaturated heterocyclic groups containing at least one nitrogen atom and at least one sulfur atom include thiazole, isothiazole, benzothiazole, benzoisothiazole, thiazoline, and 1,3,4-thiadiazole rings.

In some embodiments, any of the generic substituents (e.g., R, $R^1$, $R^2$, $R^3$, $R^4$, $R^5$, and $R^6$, and the like) described below may independently exclude any one or more of the classes, subclasses, or particular hydrocarbon groups described above, or may independently include only specific hydrocarbon groups selected from the hydrocarbon groups (R) described above. Similarly, any of the generic substituents described below may independently exclude any one or more heteroatoms or heteroatom-containing groups.

In a particular aspect, the invention is directed to a novel method for producing a conversion-coated (i.e., passivated and corrosion-resistant) magnesium-containing surface (substrate). The corrosion resistance of the treated substrate is significantly improved over the corrosion resistance of the substrate before the instantly described treatment and significantly improved over the corrosion resistance of the substrate treated with an ionic liquid but where the ionic liquid has not decomposed at the surface of the substrate. The improved corrosion resistance may be evidenced by a substantial absence of corrosion even after rigorous corrosion tests, such as being treated in a salt solution of at least 0.1 M, 0.2 M, 0.5 M, 1.0 M, 1.5 M, or 2.0 M concentration for at least 0.5, 1, 2, 3, 4, 5, 6, 12, 18, 24, 36, or 48 hours.

The term "magnesium-containing", with respect to the magnesium-containing substrate before undergoing the conversion treatment described herein, encompasses any metallic substrate that contains metallic (i.e., elemental) magnesium. The amount of magnesium in the substrate is generally at least 20%, 30%, 40%, 50%, 60%, or 70%, and more typically, at least 80%, 85%, 90%, 95%, 96%, 97%, or 98%. In some embodiments, the magnesium-containing substrate is substantially all magnesium, which is generally at least 99%, 99.5%, 99.9%, or even 100% magnesium. In other embodiments, the magnesium-containing substrate is a magnesium alloy. The magnesium alloy can be any of the magnesium alloys known in the art, including a cast alloy or a wrought alloy. Some examples of magnesium alloys include the AZ31, AZ61, AZ63, AZ80, AZ81, AZ91, AM60, ZE41, ZC63, ZC71, ZK51, ZK60, ZK61, Elektron 21, Elektron 675, HK31, HM21, HZ32, QE22, QH21, WE54, and WE43 types of magnesium alloys. The alloying metal is typically selected from at least one, and typically, at least two or more of aluminum (Al), zinc (Zn), manganese (Mn), silicon (Si), copper (Cu), calcium (Ca), nickel (Ni), and iron (Fe).

In the method, the magnesium-containing substrate (i.e., "magnesium-containing surface") is contacted with the ionic liquid compound by any suitable means. For example, the magnesium-containing substrate may be immersed in the ionic liquid compound, or a coating (film) of the ionic liquid compound may be applied to the magnesium-containing substrate, e.g., by dipping, spraying, painting, or spin-coating.

During contact of the magnesium-containing substrate with the ionic liquid compound, the ionic liquid in contact with the substrate is subjected to conditions that cause the ionic liquid compound to decompose (i.e., the ionic liquid is subjected to "decomposition conditions"). In decomposing, a structural change involving the breakage and/or creation of one or more covalent bonds occurs in either the cationic or anionic component of the ionic liquid to produce decomposition products of the ionic liquid. Any conditions that result in the decomposition of the ionic liquid compound are considered herein. Without being bound by any theory, it is believed that reaction between the substrate surface and decomposition products of the ionic liquid are primarily responsible for the substantially improved corrosion resistance of the treated substrate surface.

In a first set of embodiments, the ionic liquid compound in contact with the magnesium-containing substrate is heated to a decomposing temperature to effect decomposition of the ionic liquid compound. The decomposing temperature is any temperature at which the ionic liquid decomposes, wherein it is understood that each ionic liquid possesses a distinct minimum temperature at which it decomposes. Typically, the decomposing temperature is at least 80° C., 90° C., or 100° C. In different embodiments, the decomposing temperature is precisely, about, at least, above, up to, or less than, for example, 80° C., 90° C., 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., or 500° C., or a temperature within a range bounded by any two of the foregoing temperatures. Moreover, the decomposing temperature can be selected to be the minimum decomposing temperature of the ionic liquid, or alternatively, a temperature above the minimum decomposing temperature, e.g., a temperature of precisely, about, or at least 10, 20, 30, 40, 50, 60, 70, 80, 90, 100, 120, 140, 160, 180, or 200° C. above the minimum decomposing temperature (e.g., to ensure reaction of the IL decomposition products with the substrate surface). For purposes of the invention, the ionic liquid is required to decompose at the magnesium-containing surface (and not, for example, only or substantially in the bulk of ionic liquid not in contact with the substrate surface); thus, when a decomposing temperature is used, the magnesium-containing surface (i.e., object) is generally heated to the decomposing temperature during contact with the ionic liquid compound to effect decomposition of the ionic liquid compound specifically at the substrate surface. When the ionic liquid decomposes at the surface of the substrate, the substrate is believed to react with decomposition products at the surface. These reactions at the surface of the substrate are believed to be responsible for the significantly improved corrosion resistance observed in the treated substrate. In some embodiments, the temperature at which the process is conducted is sufficient to not only decompose the IL, but to cause or promote sufficient reaction of the IL decomposition products with the substrate surface.

The ionic liquid in contact with the substrate can be subjected to a suitable decomposing temperature, such as any of those above, for any amount of time (i.e., processing time). The amount of time that the ionic liquid in contact with the substrate is subjected to the decomposing temperature is highly dependent on the temperature employed. As would be appreciated, higher temperatures generally require smaller processing times to achieve the same or similar effect achieved for lower temperatures at longer processing times. Depending on the decomposing temperature, the processing time may be, for example, 1 minute, 2 minutes, 5 minutes, 10 minutes, 15 minutes, 20 minutes, 30 minutes, 40 minutes, 50 minutes, 1 hour, 2 hours, 3 hours, 6 hours, 12 hours, 18 hours, or 24 hours. In particular embodiments, a decomposing temperature of 150° C. to 300° C. is applied for 1-10 minutes, or a temperature of 100° C. to 150° C. is applied for 10-30 minutes, or a temperature of 300° C. to 400° C. is applied for 0.5 to 5 minutes. Moreover, the processing time may be the minimum time required to effect decomposition and reaction at the substrate surface, or a time beyond the minimum time required to effect decomposition and reaction at the substrate surface.

In a second set of embodiments, the magnesium-containing substrate is tribologically treated during contact with the ionic liquid compound to effect decomposition of the ionic liquid compound. The tribological treatment can be any of the means known in the art for tribologically treating a surface. By tribologically treating the surface is meant that the substrate surface is rubbed with another solid surface to the extent that the cation and/or anion component of the ionic liquid is decomposed by frictional heating or mechanical (shear) stresses provided by the tribological treatment. The rubbing action may or may not include transfer of a portion of the substrate material to the rubbing solid surface or vice-versa. For example, the substrate in contact with the ionic liquid may be subjected to a polishing process, or a non-polishing yet frictional process. The tribological process can be conducted at any suitable temperature, such as room temperature (generally, 18-30° C. or 20-25° C.) or an elevated temperature (e.g., precisely, about, at least, above, up to, or less than 40, 50, 60, 70, 80, 90, or 100° C., or a higher temperature as provided above), which may or may not be a decomposition temperature.

Other means for inducing decomposition of the ionic liquid may be employed. For example, the ionic liquid in contact with the substrate may undergo electrochemical decomposition by subjecting the ionic liquid to a suitable voltage. As another example, the ionic liquid in contact with the substrate may undergo photochemical decomposition by subjecting the ionic liquid to electromagnetic radiation (e.g., ultraviolet, x-ray, or gamma ray) at sufficient power. The decomposition process is suitable as long as it permits the ionic liquid to decompose at and react with the substrate surface.

In some embodiments, any of the means for decomposing the ionic liquid can be combined. For example, a substrate in contact with the ionic liquid may undergo tribological treatment while the ionic liquid is also heated to a decomposition temperature, such as any of the decomposition temperatures provided above. As another example, a substrate in contact with the ionic liquid may undergo heat treatment in addition to electrochemical or photochemical decomposition of the ionic liquid.

In some embodiments, the magnesium-containing surface is subjected to an acid pickling step prior to contacting the surface with an ionic liquid under conditions that result in decomposition of the ionic liquid. In the acid pickling step, the magnesium-containing surface is contacted with one or more acids, which can be an inorganic or organic acid. Typically, the acid is in the form of an aqueous solution, which may have a concentration of, for example, 0.1 to 10 M. Some examples of inorganic pickling acids include hydrohalogenic acids (e.g., HF, HCl, HBr, HI), nitric acid, sulfuric acid, and phosphoric acid. Some examples of organic pickling acids include carboxylic acids (e.g., acetic or propionic acids, and fluorinated versions, e.g., trifluoroacetic acid) and sulfonic acids (e.g., methylsulfonic or triflic acids). In some embodiments, any one or more of the foregoing acids are excluded from the acid pickling step.

In further embodiments, an alkaline conditioning step may be employed after the acid pickling step and prior to contacting the surface with an ionic liquid under conditions that result in decomposition of the ionic liquid. In the alkaline conditioning step, the magnesium-containing surface is contacted with one or more alkaline substances, typically in the form of an alkaline aqueous solution. Some examples of alkaline compounds that may be used in the alkaline conditioning step include the metal hydroxides (e.g., sodium hydroxide), carboxylate salts, metal carbonates or bicarbonates (e.g., sodium carbonate or bicarbonate), and amines (e.g., dimethyl or trimethyl amine).

The ionic liquid compound in contact with the surface of the magnesium-containing substrate can have any compositions of the art. As understand in the art, the term "ionic liquid compound" or "ionic liquid" is an ionic compound that is, itself, a liquid, i.e., without being dissolved in or solvated with a solvent. For purposes of the invention, both the cationic and anionic components of the ionic liquid contain at least one hydrocarbon group (R) in each.

The ionic liquid compound can be conveniently expressed by the formula $Y^+X^-$, wherein $Y^+$ is a cationic component of the ionic liquid and $X^-$ is an anionic component of the ionic liquid. The formula $(Y^+)(X^-)$ is meant to encompass a cationic component $(Y^+)$ having any valency of positive charge, and an anionic component $(X^-)$ having any valency of negative charge, provided that the charge contributions from the cationic portion and anionic portion are counter-balanced in order for charge neutrality to be preserved in the ionic liquid molecule. More specifically, the formula $(Y^+)(X^-)$ is meant to encompass the more generic formula $(Y^{+a})_y(X^{-b})_x$, wherein the variables a and b are, independently, non-zero integers, and the subscript variables x and y are, independently, non-zero integers, such that a.y=b.x (wherein the period placed between variables indicates multiplication of the variables). The foregoing generic formula encompasses numerous possible sub-formulas, such as, for example, $(Y^+)(X^-)$, $(Y^{+2})(X^-)_2$, $(Y^+)_2(X^{-2})$, $(Y^{+2})_2(X^{-2})_2$, $(Y^{+3})(X^-)_3$, $(Y^+)_3(X^{-3})$, $(Y^{+3})_2(X^{-2})_3$, and $(Y^{+2})_3(X^{-3})_2$. For simplicity, numerous embodiments of ionic liquids, described below, designate the anion as $X^-$, which in its strict sense indicates a monovalent anion. However, the anion designated as $X^-$ is meant to encompass an anion of any valency, such as any of the valencies described above and further below, unless otherwise specified. In some embodiments, $Y^-$ can be a metal cation (e.g., an alkali metal, such as $Li^+$), while in other embodiments $Y^-$ is not a metal cation. In some embodiments, $Y^+$ can be an inorganic species, while in other embodiments, r is an organic species.

The ionic liquid is typically a liquid at room temperature (e.g., 15, 18, 20, 22, 25, or 30° C.) or lower. However, in some embodiments, the ionic liquid may become a liquid at a higher temperature than 30° C. if it is used at an elevated temperature that melts the ionic liquid. Thus, in some embodiments, the ionic liquid may have a melting point of up to or less than 100, 90, 80, 70, 60, 50, 40, or 30° C. In other embodiments, the ionic liquid is a liquid at or below 10, 5, 0, −10, −20, −30, or −40° C.

The density of the ionic liquid is typically in the range of 0.6-1.6 g/mL at an operating temperature of interest, and particularly at a temperature within 20-30° C. The viscosity of the ionic liquid is typically no more than 50,000 centipoise (50,000 cP) at an operating temperature of interest, and particularly at a temperature within 20-30° C. More typically, the viscosity of the ionic liquid is no more than about 25,000 cP, 10,000 cP, 5,000 cP, 2,000 cP, 1,000 cP, 800 cP, 700 cP, 600 cP, 500 cP, 400 cP, 300 cP, 200 cP, 100 cP, or 50 cP.

In particular embodiments, the cationic group $Y^+$ of the ionic liquid has the generic formula:

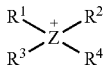

(1)

In Formula (1), Z is either N or P, and $R^1$, $R^2$, $R^3$, and $R^4$ are each independently selected from hydrogen atom and hydrocarbon groups (R) having at least one and up to twenty carbon atoms and optionally substituted with one or more heteroatoms selected from fluorine, nitrogen, oxygen, and sulfur, as described above for hydrocarbon groups R, provided that at least one of $R^1$, $R^2$, $R^3$, and $R^4$ is a hydrocarbon group R when Z is N, and provided that $R^1$, $R^2$, $R^3$, and $R^4$ are all hydrocarbon groups when Z is P. In particular embodiments, one, two, three, or all of $R^1$, $R^2$, $R^3$, and $R^4$ are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms. In other embodiments, one, two, three, or all of $R^1$, $R^2$, $R^3$, and $R^4$ are selected from saturated or unsaturated cyclic hydrocarbon groups, which may be carbocyclic (e.g., cycloalkyl or aryl) or heterocyclic (e.g., heterocycloalkyl or heteroaryl).

In particular embodiments of Formula (1), Z is N, which corresponds to ammonium species having the following formula:

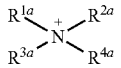

(1a)

In Formula (1a), $R^{1a}$, $R^{2a}$, $R^{3a}$, and $R^{4a}$ are each independently selected from hydrogen atom and hydrocarbon groups (R) having at least one and up to twenty carbon atoms and optionally substituted with one or more heteroatoms selected from fluorine, nitrogen, oxygen, and sulfur, as described above for hydrocarbon groups R, provided that at least one of $R^{1a}$, $R^{2a}$, $R^{1a}$, and $R^{4a}$ is a hydrocarbon group R.

In particular embodiments, one, two, three, or all of $R^{1a}$, $R^{2a}$, $R^{3a}$, and $R^{4a}$ of Formula (1a) are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. Some examples of such ammonium species include methylammonium, ethylammonium, vinylammonium, n-propylammonium, isopropylammonium, allylammonium, n-butylammonium, isobutylammonium, n-pentylammonium, n-hexylammonium, n-heptylammonium, n-octylammonium, 2-ethylhexylammonium, n-nonylammonium, n-decylammonium, n-undecylammonium, n-dodecylammonium, dimethylammonium, diethylammonium, divinylammonium, ethylmethylammonium, dipropylammonium, methylpropylammonium, diisopropylammonium, diallylammonium, dibutylammonium, methylbutylammonium, diisobutylammonium, dipentylammonium, methylpentylammonium, dihexylammonium, diheptylammonium, dioctylammonium, di(2-ethylhexyl) ammonium, dinonylammonium, didecylammonium, didodecylammonium, trimethylammonium, dimethylethylammonium, triethylammonium, trivinylammonium, tripropylammonium, triisopropylammonium, dimethylisopropylammonium, triallylammonium, tributylammonium, triisobutylammonium, diethylisobutylammonium, ethyldiisobutylammonium, tripentylammonium, trihexylammonium, triisohexylammonium, ethyldioctylammonium, trioctylammonium, tris(isooctyl)ammonium, methylbis(2-ethylhexyl)ammonium, tris(2-ethylhexyl)ammonium, trinonylammonium, tridecylammonium, tridodecylammonium, tetramethylammonium, tetraethylammonium, tetravinylammonium, tetrapropylammonium, tetraisopropylammonium, dimethyldiisopropylammonium, tetraallylammonium, tetrabutylammonium, tetraisobutylammonium, dimethyldiisobutylammonium, diethyldiisobutylammonium, methyltriisobutylammonium, ethyltriisobutylammonium, tetrapentylammonium, tetrahexylammonium, tetraisohexylammonium, ethyltrioctylammonium, tetraoctylammonium, tetrakis(isooctyl)ammonium, methyltris(2-ethylhexyl)ammonium, ethyltris(2-ethylhexyl)ammonium, tetrakis(2-ethylhexyl)ammonium, tetranonylammonium, tetradecylammonium, and tetradodecylammonium.

In other embodiments, one, two, three, or all of $R^{1a}$, $R^{2a}$, $R^{3a}$, and $R^{4a}$ of Formula (1a) are selected from saturated or unsaturated cyclic hydrocarbon groups, which may be carbocyclic (e.g., cycloalkyl or aryl) or heterocyclic (e.g., heterocycloalkyl or heteroaryl) and may or may not include a hydrocarbon linker and/or one more hydrocarbon substituents. Some examples of such ammonium species include trimethylcyclopentylammonium, trimethylcyclohexylammonium, trimethylphenylammonium, trimethylbenzylammonium, trimethylnaphthylammonium, triethylcyclopentylammonium, triethylcyclohexylammonium, triethylphenylammonium, triethylbenzylammonium, triisopropylcyclopentylammonium, triisopropylcyclohexylammonium, triisopropylphenylammonium, triisopropylbenzylammonium, dimethylcyclopentylammonium, dimethylcyclohexylammonium, dimethylphenylammonium, dimethylbenzylammonium, diethylcyclopentylammonium, diethylcyclohexylammonium, diethylphenylammonium, diethylbenzylammonium, diisopropylcyclopentylammonium, diisopropylcyclohexylammonium, diisopropylphenylammonium, diisopropylbenzylammonium, dimethyldicyclopentylammonium, dimethyldicyclohexylammonium, dimethyldiphenylammonium, dimethyldibenzylammonium, diethyldicyclopentylammonium, diethyldicyclohexylammonium, diethyldiphenylammonium, diethyldibenzylammonium, diisopropyldicyclopentylammonium, diisopropyldicyclohexylammonium, diisopropyldiphenylammonium, diisopropyldibenzylammonium, dihexyldiphenylammonium, dioctyldiphenylammonium, dihexyldibenzylammonium, dioctyldibenzylammonium, methyltricyclopentylammonium, methyltricyclohexylammonium, methyltriphenylammonium, methyltribenzylammonium, ethyltricyclopentylammonium, ethyltricyclohexylammonium, ethyltriphenylammonium, ethyltribenzylammonium, isopropyltricyclopentylammonium, isopropyltricyclohexylammonium, isopropyltriphenylammonium, hexyltriphenylammonium, octyltriphenylammonium, isopropyltribenzylammonium, hexyltribenzylammonium, octyltribenzylammonium, tetracyclopentylammonium, tetracyclohexylammonium, tetraphenylammonium, and tetrabenzylammonium.

In particular embodiments of Formula (1), Z is P, which corresponds to phosphonium species having the following formula:

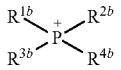

(1b)

In Formula (1b), $R^{1b}$, $R^{2b}$, $R^{3b}$, and $R^{4b}$ are each independently selected from hydrocarbon groups (R) having at least one and up to twenty carbon atoms and optionally substituted with one or more heteroatoms selected from fluorine, nitrogen, oxygen, and sulfur, as described above for hydrocarbon groups R. In particular embodiments, one, two, three, or all of $R^{1b}$, $R^{2b}$, $R^{3b}$, and $R^{4b}$ are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. In other embodiments, one, two, three, or all of $R^{1b}$, $R^{2b}$, $R^{3b}$, and $R^{4b}$ are selected from saturated or unsaturated cyclic hydrocarbon groups, which may be carbocyclic (e.g., cycloalkyl or aryl) or heterocyclic (e.g., heterocycloalkyl or heteroaryl).

In particular embodiments of Formula (1b), $R^{1b}$, $R^{2b}$, $R^{3b}$, and $R^{4b}$ of Formula (1b) are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. Some examples of such phosphonium species include tetramethylphosphonium, tetraethylphosphonium, tetravinylphosphonium, tetrapropylphosphonium, tetraisopropylphosphonium, dimethyldiisopropylphosphonium, tetraallylphosphonium, tetrabutylphosphonium, tetraisobutylphosphonium, dimethyldiisobutylphosphonium, diethyldiisobutylphosphonium, methyltriisobutylphosphonium, ethyltriisobutylphosphonium, tetrapentylphosphonium, tetrahexylphosphonium, tetrakis(isohexyl)phosphonium, ethyltrioctyiphosphonium, tetraoctylphosphonium, tetrakis(isooctyl)phosphonium, methyltris(2-ethylhexyl) phosphonium, ethyltris(2-ethylhexyl)phosphinium, tetrakis (2-ethylhexyl)phosphonium, trihexyldodecylphosphonium, tetranonylphosphonium, tetradecylphosphonium, and tetradodecylphosphonium.

In other embodiments, one, two, three, or all of $R^{1b}$, $R^{2b}$, $R^{3b}$, and $R^{4b}$ of Formula (1 b) are selected from saturated or unsaturated cyclic hydrocarbon groups, which may be carbocyclic (e.g., cycloalkyl or aryl) or heterocyclic (e.g., heterocycloalkyl or heteroaryl) and may or may not include a hydrocarbon linker and/or one more hydrocarbon substituents. Some examples of such phosphonium species include trimethylcyclopentylphosphonium, trimethylcyclohexylphosphonium, trimethylphenylphosphonium, trimethylbenzylphosphonium, trimethylnaphthylphosphonium, triethylcyclopentylphosphonium, triethylcyclohexylphosphonium, triethylphenylphosphonium, triethylbenzylphosphonium, triisopropylcyclopentylphosphonium, triisopropylcyclohexylphosphonium, triisopropylphenylphosphonium, triisopropylbenzylphosphonium, dimethyldicyclopentylphosphonium, dimethyldicyclohexylphosphonium, dimethyldiphenylphosphonium, dimethyldibenzylphosphonium, diethyldicyclopentylphosphonium, diethyldicyclohexylphosphonium, diethyldiphenylphosphonium, diethyldibenzylphosphonium, diisopropyldicyclopentylphosphonium, diisopropyldicyclohexylphosphonium, diisopropyldiphenylphosphonium, diisopropyldibenzylphosphonium, dihexyldiphenylphosphonium, dioctyldiphenylphosphonium, dihexyldibenzylphosphonium, dioctyldibenzylphosphonium, methyltricyclopentylphosphonium, methyltricyclohexylphosphonium, methyltriphenylphosphonium, methyltribenzylphosphonium, ethyltricyclopentylphosphonium, ethyltricyclohexylphosphonium, ethyltriphenylphosphonium, ethyltribenzylphosphonium, isopropyltricyclopentylphosphonium, isopropyltricyclohexylphosphonium, isopropyltriphenylphosphonium, hexyltriphenylphosphonium, octyltriphenylphosphonium, dodecyltriphenylphosphonium, isopropyltribenzylphosphonium, hexyltribenzylphosphonium, octyltribenzylphosphonium, tetracyclopentylphosphonium, tetracyclohexylphosphonium, tetraphenylphosphonium, and tetrabenzylphosphonium.

In the cationic species of Formula (1), two or more of $R^1$, $R^2$, $R^3$, and $R^4$ may (i.e., optionally) be combined to form one or more cyclic groups that includes Z as a ring heteroatom. By analogy, two or more of $R^{1a}$, $R^{2a}$, $R^{3a}$, and $R^{4a}$ of Formula (1a), or two or more of $R^{1b}$, $R^{2b}$, $R^{3b}$, and $R^{4b}$ of Formula (1b), may (i.e., optionally) be combined to form one or more cyclic groups that includes Z as a ring heteroatom. Thus, if $R^1$ and $R^2$ are taken as ethyl groups, $R^1$ and $R^2$ may interconnect to form a five-membered ring that includes Z. The interconnected moiety may also contain one or more heteroatoms as a ring heteroatom, in addition to Z. Alternatively, or in addition to two or more of $R^1$, $R^2$, $R^3$, and $R^4$ interconnecting to form a ring, two of $R^1$, $R^2$, $R^3$, and $R^4$ may (i.e., optionally) be combined to form a group linked to Z by a double bond.

For example, $R^{1a}$ and $R^{2a}$ in Formula (1a) or $R^{1b}$ and $R^{2b}$ in Formula (1b) can be interconnected to result in cationic species having any of the following formulas:

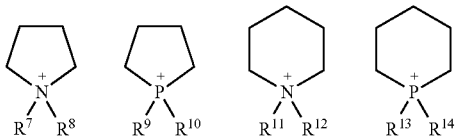

In the above formulas, $R^7$, $R^8$, $R^9$, $R^{10}$, $R^{11}$, $R^{12}$, $R^{13}$, and $R^{14}$ are each independently selected from hydrogen atom and hydrocarbon groups (R) having at least one and up to twenty carbon atoms and optionally substituted with one or more heteroatoms selected from fluorine, nitrogen, oxygen, and sulfur, as described above for hydrocarbon groups R, provided that $R^9$, $R^{10}$, $R^{13}$, and $R^{14}$ of the cyclic phosphonium species are all hydrocarbon groups R. Moreover, any of the groups, above, that are not shown as interconnected, may either interconnect with each other to make a second ring that includes N or P, or may interconnect with the existing ring to form a bicyclic structure. Some examples of such structures include:

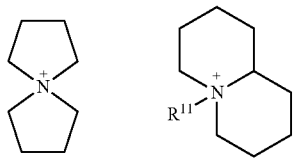

The interconnection of $R^{1a}$ and $R^{2a}$ in Formula (1a) or $R^{1b}$ and $R^{2b}$ in Formula (1b) can also include one or more heteroatoms. Some examples of such cationic species include:

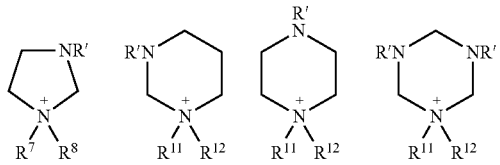

In the above structures, $R^7$, $R^8$, $R^{11}$, and $R^{12}$ are as defined above. The group R' bound to the additional one or more hydrogen atoms is independently selected from hydrogen atom and any of the hydrocarbon groups (R) described above, particularly straight-chained or branched alkyl and/or alkenyl groups having 1, 2, 3, 4, 5, or 6 carbon atoms.

The interconnection of $R^{1a}$ and $R^{2a}$ in Formula (1a) or $R^{1b}$ and $R^{2b}$ in Formula (1b) can also be accompanied by one or more double bonds in the ring containing N or P. If one of the double bonds is connected to N or P in the ring, then one of $R^{3a}$ and $R^{4a}$ in Formula (1a) or one of $R^{3b}$ and $R^{4b}$ in Formula (1b) participates to make a double bond in the ring. If none of the double bonds are connected to N or P in the ring, then $R^{3a}$ and $R^{4a}$ in Formula (1a) or $R^{3b}$ and $R^{4b}$ in Formula (1b) are not required to participate in making a double bond in the ring, i.e., the double bond originated in this case from one of $R^{1a}$ and $R^{2a}$ in Formula (1a) or one of $R^{1b}$ and $R^{2b}$ in Formula (1b). As above, the interconnection may or may not also include one or more heteroatoms. Some examples of such cationic species include:

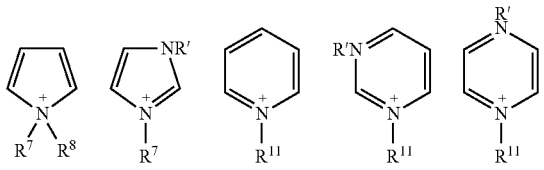

In yet other embodiments, the cationic component $Y^+$ of the ionic liquid compound may be a sulfonium species of the formula:

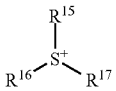

In the above formula, $R^{15}$, $R^{16}$, and $R^{17}$ are each independently selected from hydrocarbon groups (R) having at least one and up to twenty carbon atoms and optionally substituted with one or more heteroatoms selected from fluorine, nitrogen, oxygen, and sulfur, as described above for hydrocarbon groups R. In particular embodiments, one, two, or all of $R^{15}$, $R^{16}$, and $R^{17}$ are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. In other embodiments, one, two, or all of $R^{15}$, $R^{16}$, and $R^{17}$ are selected from saturated or unsaturated cyclic hydrocarbon groups. Moreover, as provided for the ammonium and phosphonium species in Formulas (1), (1a), and (1b), two or three of $R^{15}$, $R^{16}$, and $R^{17}$ can be interconnected to form a cyclic or bicyclic structure.

In still other embodiments, the cationic component $Y^+$ of the ionic liquid compound may be a guanidinium species of the formula:

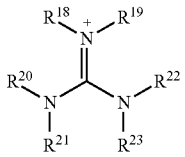

In the above formula, $R^{18}$, $R^{19}$, $R^{20}$, $R^{21}$, $R^{22}$, and $R^{23}$ are each independently selected from hydrocarbon groups (R) having at least one and up to twenty carbon atoms and optionally substituted with one or more heteroatoms selected from fluorine, nitrogen, oxygen, and sulfur, as described above for hydrocarbon groups R. In particular embodiments, one, two, three, four, five, or all of $R^{18}$, $R^{19}$, $R^{20}$, $R^{21}$, $R^{22}$, and $R^{23}$ are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. In other embodiments, one, two, three, four, five, or all of $R^{18}$, $R^{19}$, $R^{20}$, $R^{21}$, $R^{22}$, and $R^{23}$ are selected from saturated or unsaturated cyclic hydrocarbon groups. Moreover, as provided for the ammonium and phosphonium species in Formulas (1), (1a), and (1b), any one or more of $R^{18}$, $R^{19}$, $R^{20}$, $R^{21}$, $R^{22}$, and $R^{23}$ can be interconnected to form a cyclic or bicyclic structure.

The anionic component $X^-$ of the ionic liquid compound is any counteranion which, when associated with the cationic component, permits the resulting ionic compound to behave as an ionic liquid. As known in the art, the composition and structure of the counteranion strongly affects the properties (e.g., melting point, volatility, stability, viscosity, hydrophobicity, and so on) of the ionic liquid. In some embodiments, the counteranion is structurally symmetrical, while in other embodiments, the counteranion is structurally asymmetrical.

In one embodiment, the counteranion ($X^-$) of the ionic liquid is inorganic. The inorganic counteranion may, in one embodiment, lack fluorine atoms. Some examples of such counteranions include chloride, bromide, iodide, hexachlorophosphate ($PCl_6^-$), perchlorate, chlorate, chlorite, cyanate, isocyanate, thiocyanate, isothiocyanate, perbromate, bromate, bromite, periodiate, iodate, dicyanamide (i.e., $N(CN)_2^-$), tricyanamide (i.e., $N(CN)_3^-$), aluminum chlorides (e.g., $Al_2Cl_7^-$ and $AlCl_4^-$), aluminum bromides (e.g., $AlBr_4^-$), nitrate, nitrite, sulfate, sulfite, hydrogensulfate, hydrogensulfite, phosphate, hydrogenphosphate ($HPO_4^{2-}$), dihydrogenphosphate ($H_2PO_4^-$), phosphite, arsenate, antimonate, selenate, tellurate, tungstate, molybdate, chromate, silicate, the borates (e.g., borate, diborate, triborate, tetraborate), anionic borane and carborane clusters (e.g., $B_{10}H_{10}^{2-}$ and $B_{12}H_{12}^{2-}$), perrhenate, permanganate, ruthenate, perruthenate, and the polyoxometallates. The inorganic counteranion may, in another embodiment, include fluorine atoms. Some examples of such counteranions include fluoride, bifluoride ($HF_2^-$), hexafluorophosphate ($PF_6^-$), fluorophosphate ($PO_3F^{2-}$), tetrafluoroborate ($BF_4^-$), aluminum fluorides (e.g., $AlF_4^-$), hexafluoroarsenate ($AsF_6^-$), and hexafluoroantimonate ($SbF_6^-$).

In another embodiment, the counteranion ($X^-$) of the ionic liquid is organic. The organic counteranion may, in one embodiment, lack fluorine atoms. Some examples of such counteranions include carbonate, bicarbonate, the carboxylates (e.g., formate, acetate, propionate, butyrate, valerate, lactate, pyruvate, oxalate, malonate, glutarate, adipate, decanoate, salicylate, ibuprofenate, and the like), the sulfonates (e.g., $CH_3SO_3^-$, $CH_3CH_2SO_3^-$, $CH_3(CH_2)_2SO_3^-$, benzenesulfonate, toluenesulfonate, dodecylbenzenesulfonate, docusate, and the like), the alkoxides (e.g., methoxide, ethoxide, isopropoxide, phenoxide, and glycolate), the amides (e.g., dimethylamide and diisopropylamide), diketonates (e.g., acetylacetonate), the organoborates (e.g., $BR_1R_2R_3R_4^-$, wherein $R_1$, $R_2$, $R_3$, $R_4$ are typically hydrocarbon groups containing 1 to 6 carbon atoms), the alkylsulfates (e.g., diethylsulfate), hydrocarbylphosphates (e.g., ethylphosphate or diethylphosphate), hydrocarbylphosphonates (e.g., diethylphosphonate, diisopropylphosphonate, dibutylphosphonate, or bis-(2,4,4-trimethylpentyl)phosphonate), phosphinates (e.g., bis-(2,4,4-trimethylpentyl)phosphinate), and the analogous thio, dithio, and trithio versions of the phosphates, phosphonates, and phosphinates. The organic counteranion may, in another embodiment, include fluorine atoms. Some examples of such counteranions include the fluorosulfonates (e.g., $CF_3SO_3^-$, $CF_3CF_2SO_3^-$, $CF_3(CF_2)_2S0_3^-$, $CHF_2CF_2SO_3^-$, and the like), the fluoroalkoxides (e.g., $CF_3O^-$, $CF_3CH_2O^-$, $CF_3CF_2O^-$, and pentafluorophenolate), the fluorocarboxylates (e.g., trifluoroacetate and pentafluoropropionate), and the fluorosulfonylimides (e.g., $(CF_3SO_2)_2N$).

In particular embodiments, the counteranion ($X^-$) of the ionic liquid has a structure according to the following general formula:

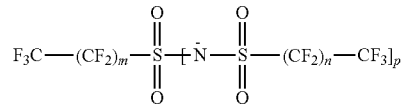

In above formula, subscripts m and n are independently 0 or an integer of 1 or above. Subscript p is 0 or 1, provided that when p is 0, the group —N—$SO_2$—$(CF_2)_nCF_3$ subtended by p is replaced with an oxide atom connected to the sulfur atom (S). The generic structures corresponding to when p is 1 or 0 are, respectively:

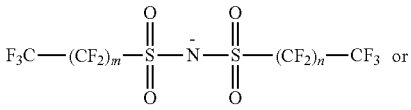

-continued

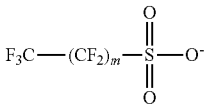

In other particular embodiments, the counteranion ($X^-$) of the ionic liquid is a phosphorus-containing anion, including any of the phosphorus-containing anions identified above. In further specific embodiments, the phosphorus-containing anion has the generic formula:

(2)

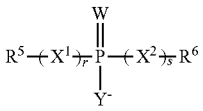

In Formula (2), $R^5$ and $R^6$ are independently selected from hydrocarbon groups having at least one and up to twenty carbon atoms, wherein the hydrocarbon groups are optionally substituted with one or more fluorine atoms. The groups $X^1$, $X^2$, W, and Y are independently selected from O and S atoms, and the subscripts r and s are independently selected from 0 and 1. In particular embodiments, one or both of $R^5$ and $R^6$ are selected from straight-chained or branched alkyl and/or alkenyl groups having at least 1, 2, 3, or 4 and up to 5, 6, 7, 8, 9, 10, 11, 12, 13, 14, 15, 16, 17, 18, 19, or 20 carbon atoms, or at least 5, 6, 7, or 8 and up to 9, 10, 11, 12, 13, 14, 15, 16, 17, 18, 19, or 20 carbon atoms. In other embodiments, one or both of $R^5$ and $R^6$ are selected from saturated or unsaturated cyclic hydrocarbon groups. Moreover, as provided for the ammonium and phosphonium species in Formulas (1), (1a), and (1b), $R^5$ and $R^6$ can optionally be interconnected to form a cyclic structure.

In one set of embodiments of Formula (2), all of $X^1$, $X^2$, W, and Y are oxygen atoms, which corresponds to the following sub-formula:

(3)

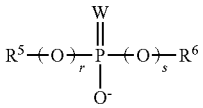

In a separate set of embodiments of Formula (2), subscripts r and s are both 1, which corresponds to the following sub-formula:

(2a)

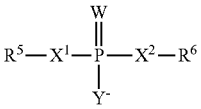

In one set of embodiments of Formula (2a), all of $X^1$, $X^2$, W, and Y are oxygen atoms, which corresponds to the following sub-formula (i.e., phosphate diester):

(3a)

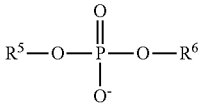

In another set of embodiments of Formula (2a), one of $X^1$, $X^2$, W, and Y is a sulfur atom. Generally, the single sulfur atom is at group W, which corresponds to the following sub-formula (i.e., thiophosphate diester):

(3b)

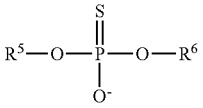

In another set of embodiments of Formula (2a), two of $X^1$, $X^2$, W, and Y are sulfur atoms. Generally, the two sulfur atoms are at groups W and Y, which corresponds to the following sub-formula (i.e., dithiophosphate diester):

(3c)

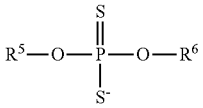

In the above formula, one or two of the remaining oxygen atoms may be replaced with sulfur atoms to result in a trithiophosphate or tetrathiophosphate species, respectively.

In a separate set of embodiments of Formula (2), one of subscripts r and s is 0 (e.g., r is 1 and s is 0), which corresponds to the following sub-formula:

(2b)

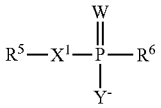

In one set of embodiments of Formula (2b), all of $X^1$, W, and Y are oxygen atoms, which corresponds to the following sub-formula (i.e., phosphonate ester):

(3d)

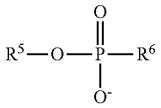

In another set of embodiments of Formula (2b), one of $X^1$, W, and Y is a sulfur atom. Generally, the single sulfur atom is at group W, which corresponds to the following sub-formula (i.e., thiophosphonate ester):

(3e)

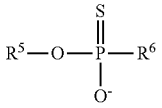

In another set of embodiments of Formula (2a), two of $X^1$, W, and Y are sulfur atoms. Generally, the two sulfur atoms are at groups W and Y, which corresponds to the following sub-formula (i.e., dithiophosphonate ester):

(3f)

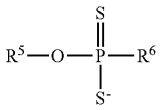

In the above formula, the remaining oxygen atom may be replaced with a sulfur atom to result in a trithiophosphonate species.

In a separate set of embodiments of Formula (2), both subscripts r and s are 0, which corresponds to the following sub-formula:

(2c)

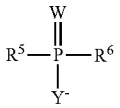

In one set of embodiments of Formula (2c), both of W and Y are oxygen atoms, which corresponds to the following sub-formula (i.e., phosphinate):

(3g)

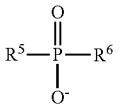

In another set of embodiments of Formula (2c), one of W and Y is a sulfur atom. Generally, the single sulfur atom is at group W, which corresponds to the following sub-formula (i.e., thiophosphinate):

(3h)

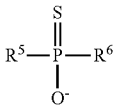

In another set of embodiments of Formula (2c), both W and Y are sulfur atoms, which corresponds to the following sub-formula (i.e., dithiophosphinate):

(3i)

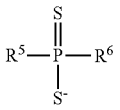

In yet other embodiments of Formula (2) or any of its sub-formulas, r and s are both 1 (i.e., $X^1$ and $X^2$ are both present), but one of $R^5$ or $R^6$ may be absent, which results in a divalent anion. The divalent anion can be depicted, for example, as follows:

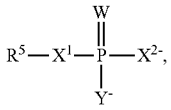

or in exemplary sub-embodiments thereof:

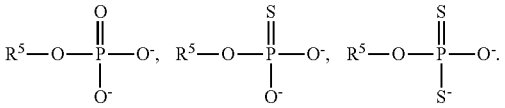

The ionic liquid compound includes any of the above cationic species $Y^+$ and any of the above anionic species $X^-$. Thus, in particular embodiments, the ionic liquid compound can be expressed according to the generic formula:

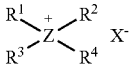

or according to any of the sub-generic formulas:

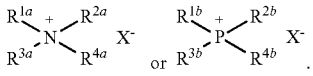

In some embodiments, a single ionic liquid compound is used, while in other embodiments, a combination of two or more ionic liquid compounds may be used. The combination of ionic liquid compounds may correspond to the inclusion of two or more cationic species (such as those described above) in the presence of one, two, or more anionic species (such as those described above). Alternatively, the combination of liquid compounds may correspond to the inclusion of a single cationic species in the presence of two or more anionic species.

In one embodiment, the ionic liquid is not dissolved or otherwise mixed or in contact with a non-ionic liquid solvent (i.e., "solvent") during contact of the ionic liquid with the substrate surface. In other embodiments, the ionic liquid is dissolved or otherwise mixed or in contact with one or more solvents during contact of the ionic liquid with the substrate surface. The solvent can be, for example, protic or non-protic and either polar or non-polar. Some examples of protic solvents include water and the alcohols (e.g., methanol, ethanol, n-propanol, isopropanol, n-butanol, and isobutanol). Some examples of polar aprotic solvents include ether, ester, nitrile, sulfoxide, and amide solvents. Some examples of ether solvents include diethyl ether, 1,2-dimethoxyethane, 1,2-diethoxyethane, 1,3-dioxolane, tetrahydrofuran, 2-methyltetrahydrofuran, tetrahydropyran, diglyme, triglyme, 1,3-dioxolane, and the fluorinated ethers (e.g., mono-, di-, tri-, tetra-, penta-, hexa- and per-fluoro derivatives of any of the foregoing ethers). Some examples of ester solvents include 1,4-butyrolactone, ethylacetate, methylpropionate, ethylpropionate, propylpropionate, methylbutyrate, ethylbutyrate, the formates (e.g., methyl formate, ethyl formate, or propyl formate), and the fluorinated esters (e.g., mono-, di-, tri-, tetra-, penta-, hexa- and per-fluoro derivatives of any of the foregoing esters). Some examples of nitrile solvents include acetonitrile, propionitrile, and butyronitrile. Some examples of sulfoxide solvents include dimethyl sulfoxide, ethyl methyl sulfoxide, diethyl sulfoxide, methyl propyl sulfoxide, and ethyl propyl sulfoxide. Some examples of amide solvents include formamide, N,N-dimethylformamide, N,N-diethylformamide, acetamide, dimethylacetamide, diethylacetamide, gamma-butyrolactam, and N-methylpyrrolidone. The polar aprotic solvent may also be, for example, an organochloride (e.g., methylene chloride, chloroform, 1,1,-trichloroethane), ketone (e.g., acetone, 2-butanone), organoethers (e.g., diethyl ether, tetrahydrofuran, and dioxane), hexamethylphosphoramide (HMPA), N-methylpyrrolidinone (NMP), 1,3-dimethyl-3,4,5,6-tetrahydro-2(1H)-pyrimidinone (DMPU), and propylene glycol monomethyl ether acetate (PGMEA). Some examples of non-polar solvents include the liquid hydrocarbons, such as the pentanes, hexanes, heptanes, octanes, pentenes, hexenes, heptenes, octenes, benzene, toluenes, or xylenes. In some embodiments, one or more classes or specific types of any of the above solvents are not included with the ionic liquid during the treatment process.

In another aspect, the invention is directed to a mechanical component or device (and more generally, an object) containing the passivated magnesium-containing surface described above. The mechanical component can be, for example, one which is intended to be used in operations that subject the component or device to moderate to severe wear and physical or tribological stress. An example of such a mechanical component is a bearing, such as a slide bearing. Other types of mechanical components considered herein include engine parts, rotary blades, turbine fans, compressor blades, pistons, and structural components (e.g., framework of an automobile or airplane). The mechanical component or device can also have any suitable shape or form. For example, in different embodiments, the passivated magnesium-containing substrate may have a generally cylindrical, tubular, ring, spherical, ingot, disk (e.g., circular blade or saw), sheet, wire, mesh, grooved, particulate, or jagged type of shape, depending on the particular application.

Examples have been set forth below for the purpose of illustration and to describe certain specific embodiments of the invention. However, the scope of this invention is not to be in any way limited by the examples set forth herein.

EXAMPLE 1

Synthesis of Ionic Liquids

Synthesis of the aprotic ionic liquid tetraoctylammonium bis(2-ethylhexyl)phosphate ([N8888][DEHP])

Tetraoctylammonium bis(2-ethylhexyl)phosphate ([N8888][DEHP]) was synthesized by the following general scheme:

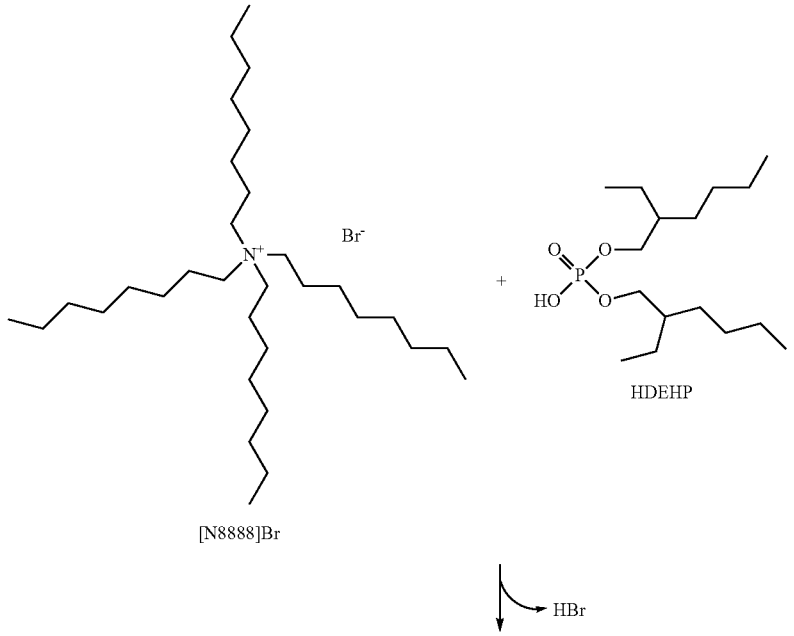

-continued

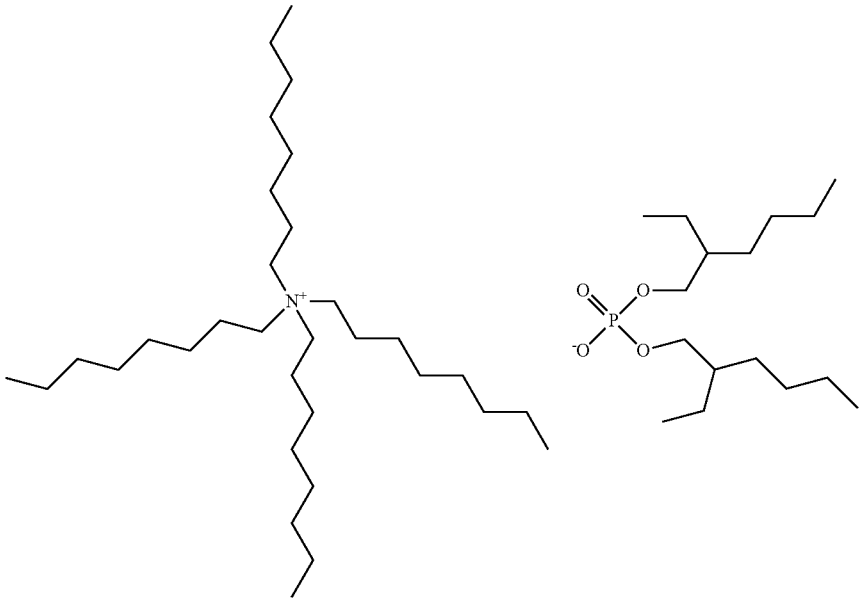

[N8888][DEHP]

Specifically, tetraoctylammonium bromide ([N8888]Br, 11.05 g, 20.2 mmol) and di(2-ethylhexyl)phosphoric acid (HDEHP, 6.53 g, 20.2 mmol) were mixed in 50 mL of deionized water (DI $H_2O$, 18.2 MΩ-cm) and 30 mL of hexanes. To this stirred suspension was added a solution of sodium hydroxide (NaOH, 0.808 g, 20.2 mmol) in 25 mL of DI water dropwise at room temperature. The white suspension became clear after the addition of NaOH was completed. The mixture continued to be stirred at room temperature overnight. The upper organic phase was separated and washed with DI water four times to ensure removal of NaBr. Solvents were distilled off by rotary evaporator and the product was dried at 70° C. under vacuum for 4 hours to yield [N8888][DEHP] as a viscous liquid (14.93 g, 18.9 mmol, yield: 93.8%). The water content of [N8888][DEHP] was found to be 0.3%. TGA: Tonset=236° C.

Synthesis of the protic ionic liquid trioctylammonium di(2-ethylhexyl)phosphate ([N888H][DEHP])

Trioctylammonium di(2-ethylhexyl)phosphate ([N888H][DEHP]) was synthesized by the following general scheme:

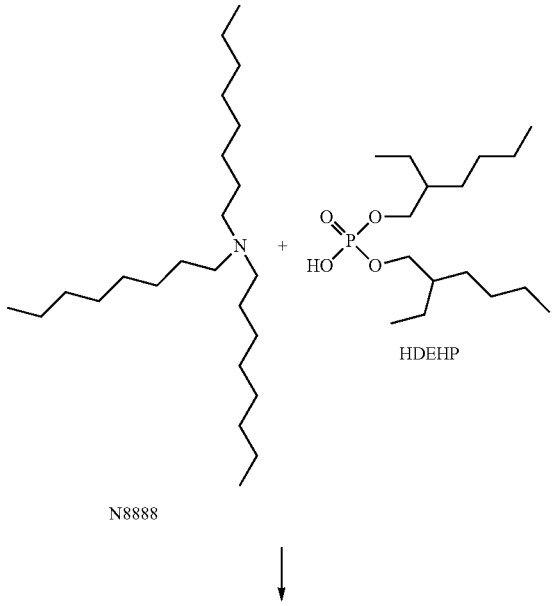

-continued

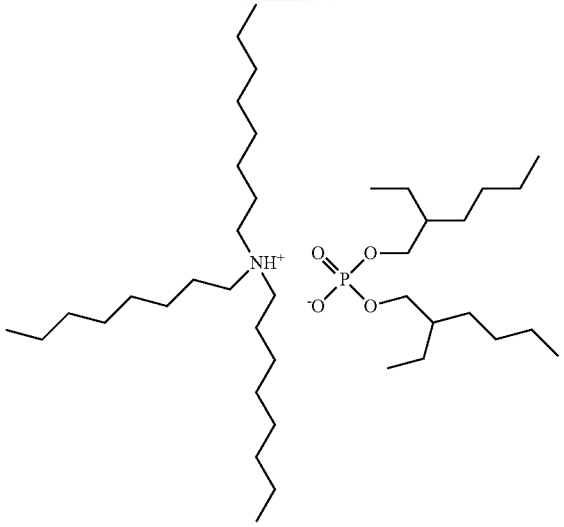

[N888H][DEHP]

Specifically, the protic IL [N888H][DEHP] was synthesized by neutralization of an equal molar ratio of trioctylamine (2.37 g, 6.69 mmol) and di(2-ethylhexyl) phosphoric acid (HDEHP, 2.16 g, 6.69 mmol) at room temperature for two hours. The mixture became more viscous upon stirring. The water content of [N888H] [DEHP] was 980 ppm. TGA: Tonset=239° C.

Numerous other ionic liquids can be synthesized by analogous or similar methods to those provided above. For example, ionic liquids having a phosphonium cation can similarly be prepared. For example, trihexyltetradecylphosphonium bis(2-ethylhexyl) phosphate ([P66614][DEHP]) may be prepared by reaction of trihexyltetradecylphosphonium bromide ([P66614]Br) with di(2-ethylhexyl)phosphoric acid (HDEHP). Numerous other ionic liquids within the scope of ionic liquids described herein can be obtained commercially, or synthesized, if necessary, by methods analogous to those herein described and as well known in the art.

EXAMPLE 2

Ionic Liquid (IL) Thermoconversion of Mg AZ31B Blocks (25.4 mm×19.05 mm×6.35 mm) at a Temperature of 250° C.

The Mg AZ31B material used in these experiments is a wrought alloy believed to have the following approximate composition, as provided in Table 1 below:

TABLE 1

Standard composition of AZ31B in wt % (S. Housh, et al., "Properties of Magnesium Alloys", ASM Handbook, ASM International, Vol 2 (1990) pp. 480-516)

| | Element | | | | | | | | | |
|---|---|---|---|---|---|---|---|---|---|---|
| | Al | Zn | Mn | Ca | Si | Cu | Ni | Fe | other (total) | Mg |
| Wt. % | 2.5-3.5 | 0.6-1.4 | 0.2 min | 0.04 max | 0.1 max | 0.05 max | 0.005 max | 0.005 max | 0.3 max | Bal. |

All surfaces were polished using SiC abrasive papers up to grit P1200. The first block was untreated. The second block was covered by a thin film of the IL tetraoctylammonium bis(2-ethylhexyl)phosphate ([N8888][DEHP]) and was kept at ambient (room temperature, i.e., "RT") environment overnight. The third block was wetted by the same IL and then baked at 250° C. (i.e., high temperature or "HT") for 5 minutes followed by an air cool. Both coupons after the treatment were rinsed with ethanol and then distilled water to remove any residual IL. All three coupons were then immersed in a 0.1 M NaCl solution. As shown by the photograph in FIG. 1(A), for the untreated block, localized pitting started appearing after only a few minutes exposure to the salt water and the pitting damage spread to most of the surface after 2 hours. As shown by the photograph in FIG. 1(B), the IL RT-treated block was corroded, although less severe than the untreated one. In contrast, as shown by the photograph in FIG. 1(C), the IL HT-treated block showed virtually no corrosion after 2 hours of exposure. Since the amine-phosphate IL starts oxidizing below 200° C. in air (as measured by TGA), it is assumed that the IL quickly decomposed at 250° C. and reacted with the Mg surface to form a conversion coating (film).

EXAMPLE 3

Ionic Liquid (IL) Tribo-Conversion of a Mg AM60B Alloy Disc (38.1 mm diameter and 3.18 mm thick)

Figures 2A, 2B:
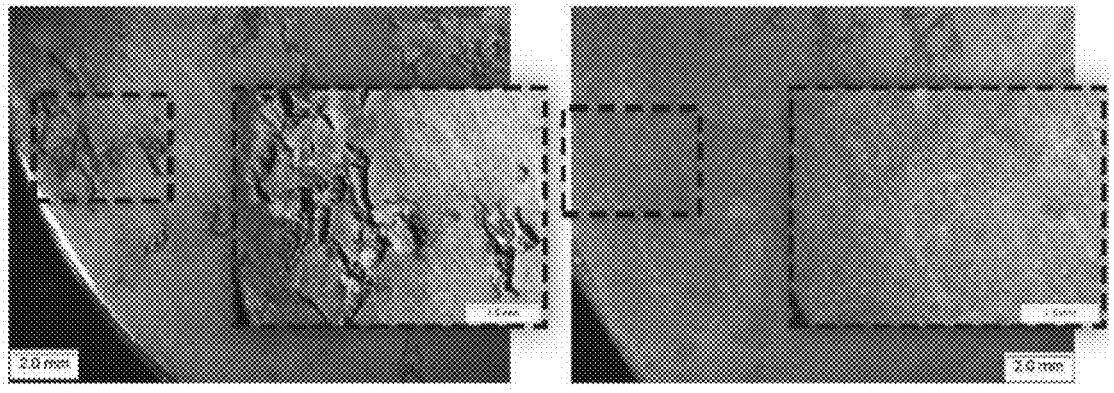
FIGS. 2A, 2B. A Mg AM60B disc, one side untreated by being polished in water (FIG. 2A) and the other side treated by tribo-conversion using trihexyltetradecylphosphonium bis(2-ethylhexyl) phosphate ([P66614][DEHP]) ionic liquid (FIG. 2B), after immersion in a 1.0 M NaCl solution for 4 hours.

One side of a Mg AM60B disc was polished with SiC abrasive papers up to grit P4000 while in contact with distilled water. The foregoing treated side of the disc is herein referred to as "untreated". The other side of the disc was subjected to the same procedure, except that in the last step of polishing, the IL trihexyltetradecylphosphonium bis(2-ethylhexyl)phosphate ([P66614][DEHP]) was used instead of water. The foregoing treated side of the disc is herein referred to as "IL tribo-treated". After the treatments, the entire disc was cleaned by organic solvents and dried before immersion in 1.0 M NaCl solution for 4 hours (higher CF concentration was used because of the better corrosion resistance of AM60B compared to AZ31B alloy). FIG. 2A is a photograph showing the untreated side (polished in water) after the four-hour treatment in 1.0 M NaCl, while FIG. 2B is a photograph showing the IL tribo-treated side after the four-hour treatment in 1.0 M NaCl. As shown by comparing the photographs, the untreated side (FIG. 2A) was severely corroded with clusters of pitting and cracking damage on the surface. In contrast, the IL tribo-treated surface (FIG. 2B) remained largely intact, suggesting the existence of an effective conversion coating. The thermo-mechanical stresses involved in the abrasion-based treatment is believed to provide the improved conversion coating in three ways: (1) removing surface oxides and contaminants in situ to expose fresh active metallic phases; (2) breaking down the phosphonium cations and/or phosphate anions to smaller, presumably more reactive species; and (3) accelerating the reactions between the phosphorus species and the metallic surface to form a conversion film.

EXAMPLE 4

Square (25.4 mm×19.05 mm×6.35 mm) and disk (15 mm diameter×3 mm thickness) AZ31B samples were cut and the test surfaces were ground using SiC abrasive paper up to P2400. The samples were then cleaned with acetone and deionized water (DI) and dried by air stream. The conversion coating was formed by applying a layer of the ionic liquid [N888H][DEHP] to the sample surface and then heat treating the sample at 300° C. in a furnace for 7 minutes. After the heat treatment, the sample surface was cleaned with ethyl alcohol in an ultrasonic cleaner and dried by air stream. For comparison, another sample was treated at room temperature (RT) using the same IL for 24 hours.

Potentiodynamic polarization measurements were conducted at potentials from −300 to +600 mV vs. OCP (open circuit potential) at a scanning rate of 0.166 mV/s under aerated conditions at room temperature. The test solution was 1 wt. % NaCl saturated with $Mg(OH)_2$ (0.25 g/L). A three-electrode electrochemical cell was used. A Pt sheet (25 mm×25 mm×0.2 mm) was used as a counter electrode and Ag/AgCl (4M KCl electrolyte saturated with AgCl) as a reference electrode and a AZ31B disk sample with 1 $cm^2$ exposed area as a working electrode. The sample to be tested was immersed for 30 minutes in the test solution before starting the experiment.

Figure 3:
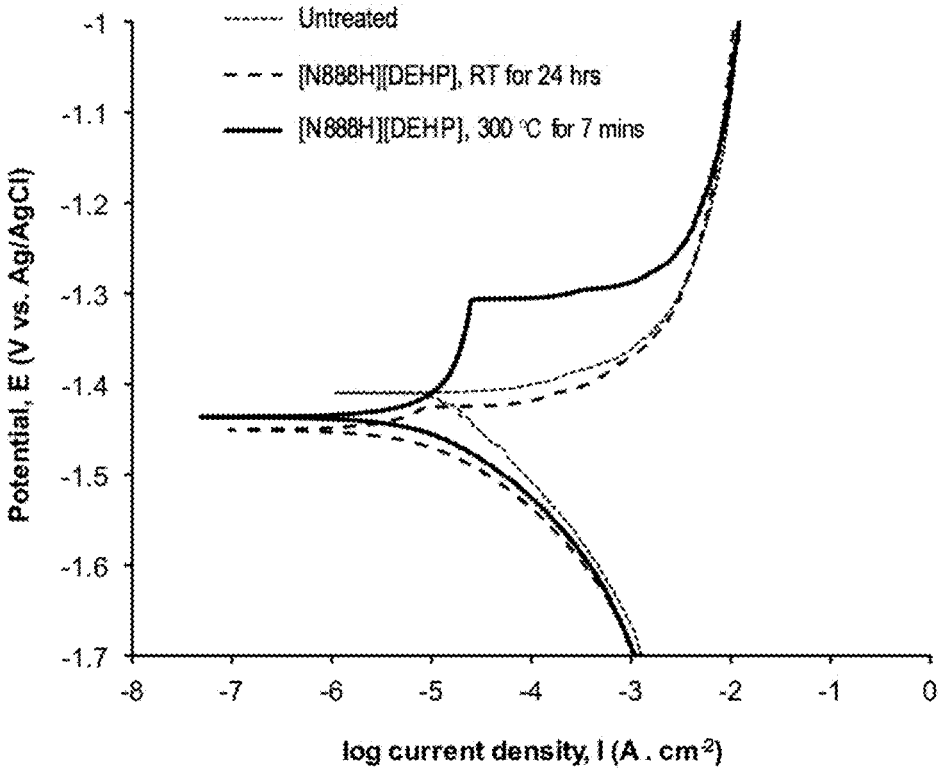
FIG. 3. Comparison of potentiodynamic polarization curves of untreated AZ31B Mg alloy and AZ31B Mg alloy treated with the protic ionic liquid trioctylammonium di(2-ethylhexyl)phosphate ([N888H][DEHP]) at room temperature (RT) or 300° C. The electrochemical measurements were conducted in a solution of 1 wt. % NaCl saturated with $Mg(OH)_2$ at room temperature. The results demonstrate a higher corrosion resistance of the 300° C.-treated surface.

FIG. 3 compares the potentiodynamic polarization curves of AZ31B Mg alloy untreated and treated with the protic ionic liquid [N888H][DEHP] at room temperature (RT) and at 300° C. The results clearly demonstrate a higher corrosion resistance for the surface treated at 300° C. as compared to the surface treated at RT.

Figure 4:
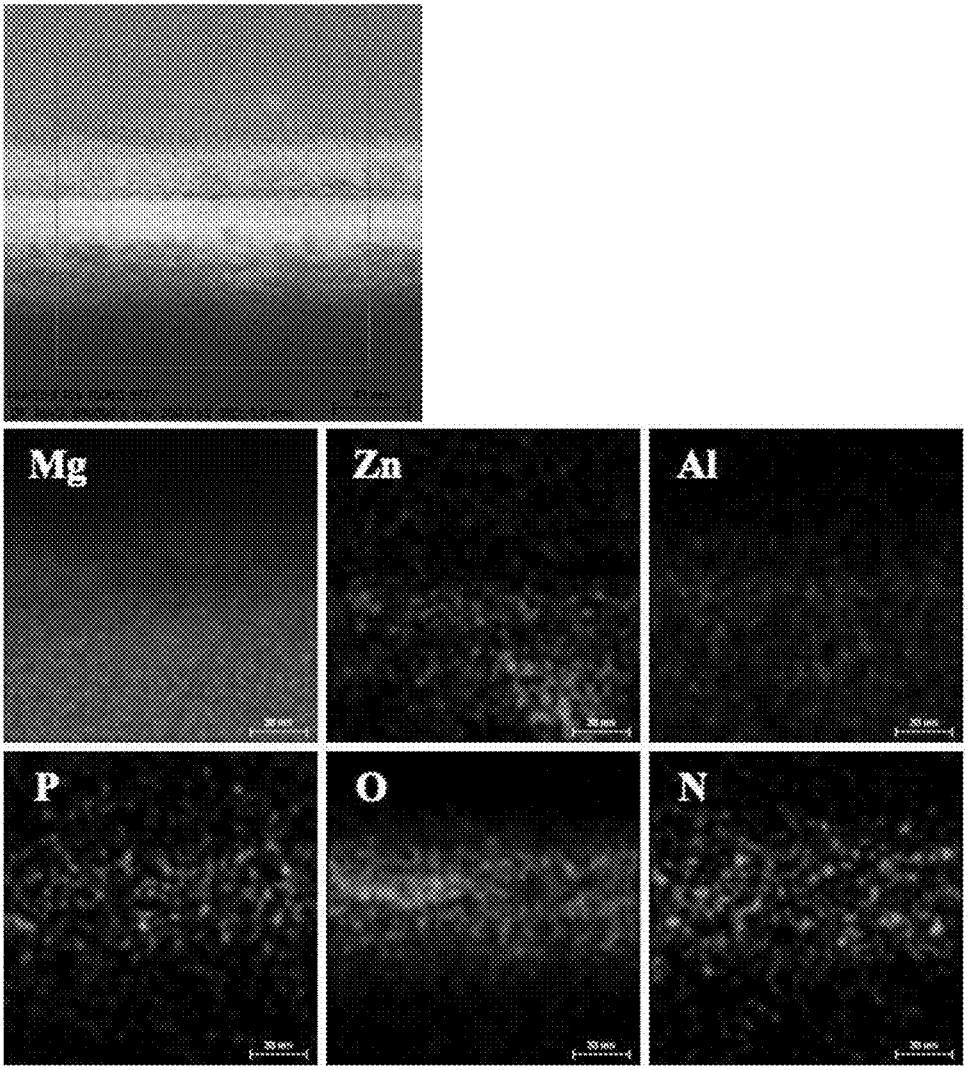
FIG. 4. Transmission electron microscopy (TEM) image (top) along with corresponding energy dispersive spectroscopy (EDS) element maps (i.e., Mg, Zn, Al, P, O, and N, as labeled) of the cross section of the Mg AZ31B surface treated with the protic ionic liquid [N888H][DEHP] at 300° C. The results revealed a two-layer structured conversion film with a total thickness of 80-100 nm. The conversion film contains elements from both the alloy (Mg, Al, Zn) and the ionic liquid (P, N) as a result of chemical reactions between the alloy surface and the ionic liquid. electron microscopy (TEM) image (top) along with corresponding energy dispersive spectroscopy (EDS) element maps (i.e., Mg, Zn, Al, P, O, and N, as labeled) of the cross section of the Mg AZ31B surface treated with [N888H][DEHP] at 300° C.

FIG. 4 shows a transmission electron microscopy (TEM) image (top) along with corresponding energy dispersive spectroscopy (EDS) element maps (i.e., Mg, Zn, Al, P, O, and N, as labeled) of the cross section of the Mg AZ31B surface treated with [N888H][DEHP] at 300° C. The TEM sample was prepared using the focused-ion-beam (FIB) technique. The images revealed a two-layer structured conversion film with a total thickness of 80-100 nm. As shown, the conversion film contains elements from both the alloy (Mg, Al, Zn) and the ionic liquid (P, N), as a result of chemical reactions between the alloy surface and the ionic liquid.

Figure 5A:
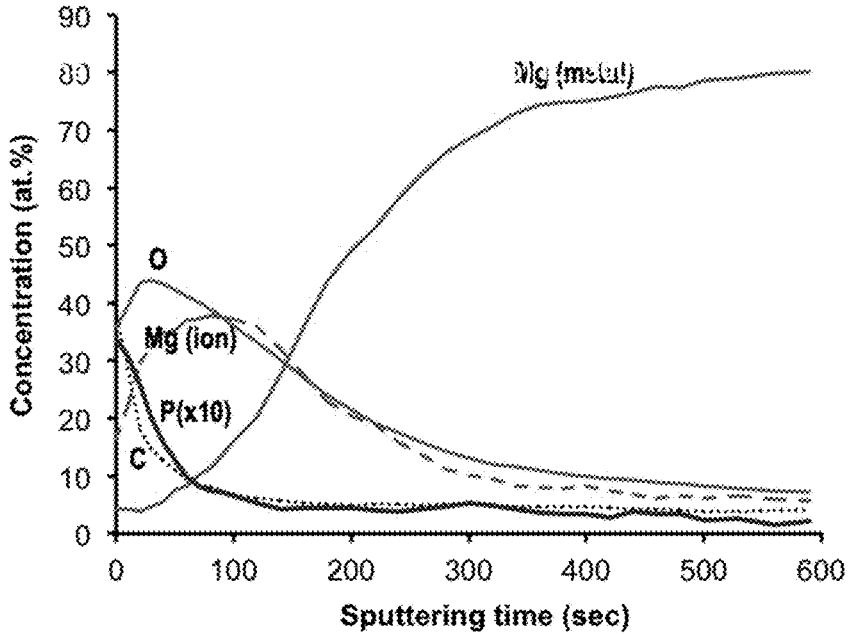
FIGS. 5A, 5B. X-ray photoelectron spectroscopy (XPS) composition-depth profile of the surface of AZ31B Mg alloy treated with the protic ionic liquid [N888H][DEHP] at 300° C., with FIGS. 5A and 5B plotting the elements of high and low concentrations, respectively.
Figure 5B:
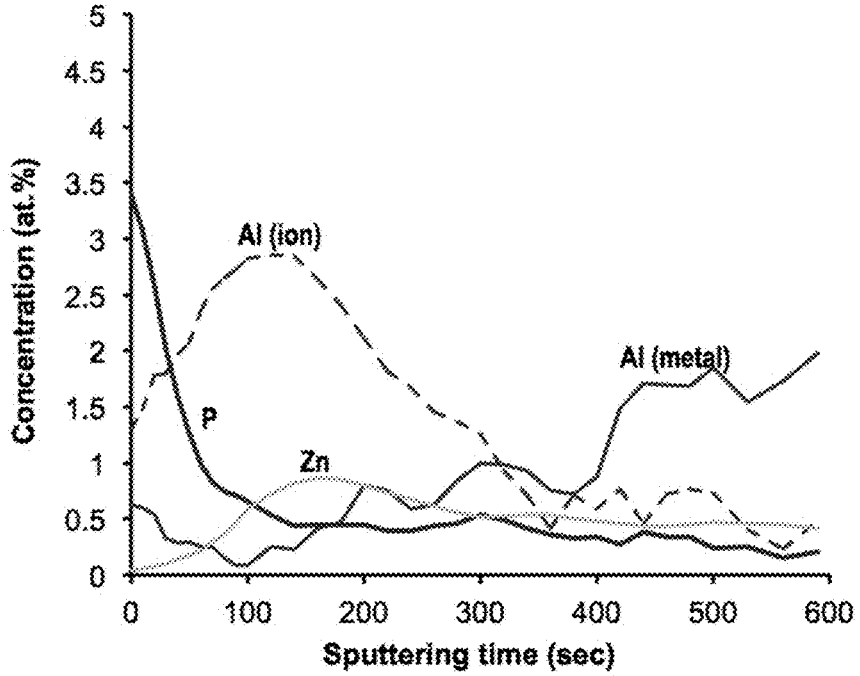

FIGS. 5A and 5B show x-ray photoelectron spectroscopy (XPS) composition-depth profiles (aided by ion-sputtering) of the surface of AZ31B Mg alloy treated with [N888H][DEHP] at 300° C., with FIGS. 5A and 5B plotting the elements of high and low concentrations, respectively. The presence of phosphorus in the near surface zone suggests the formation of an IL-induced conversion film, which appears composed of multiple magnesium phases of metal, oxide, and phosphate. This indicates that the conversion film is a product of interactions between the IL molecules and the Mg surface.

EXAMPLE 5

Ionic Liquid (IL) Thermoconversion of Mg AZ31B at a Temperature of 300° C.

Square (25.4 mm×19.05 mm×6.35 mm) and disk (15 mm diameter×3 mm thickness) samples of Mg AZ31B alloy were cut and the test surfaces were ground using SiC abrasive paper up to P2400. The samples were then cleansed with acetone and deionized water, and dried by an air stream. The conversion coating was formed by applying a layer of [N8888][DEHP] to the sample surface and then heat treating the sample at 300° C. in a furnace for 7 minutes. After the heat treatment, the sample surface was cleansed with ethanol in an ultrasonic cleaner and dried with a stream of air. For comparing the corrosion protection with the literature-reported IL treatment at room temperature (RT), another sample was treated at room temperature (RT) using the same IL for 24 hours. The name of those latter samples is joined by the suffix "RT" to distinguish them from the other IL-treated samples treated at 300° C.

This study also investigated the synergy between pretreatments and the IL coating process. Magnesium generally forms a stable protective film in a high pH solution but often is severely attacked by acid solutions with some exceptions like chromic acid ($H_2CrO_4$), hydrofluoric acid (HF), and phosphoric acid ($H_3PO_4$). Selected AZ31B samples were pickled in phosphoric ($H_3PO_4$) or nitric acid ($HNO_3$), and some were followed by conditioning in sodium hydroxide (NaOH) solution, as detailed in Table 2. The concentration of the acid or base used was 40 g/L and the application time was 20 seconds at room temperature (25±2° C.). Solutions were prepared using chemical reagents and DI water.

TABLE 2

IL conversion coating process with and without pretreatments

| Surface treatment | Sample code |
|---|---|
| As polished without treatment | as polished |
| IL-300° C. 7-min treatment (No pretreatment) | IL_300C |
| Conditioning with NaOH + IL-300° C. treatment | B+IL_300C |
| $HNO_3$ pickling + IL-300° C. treatment | N+IL_300C |
| $HNO_3$ pickling + NaOH conditioning + IL-300° C. treatment | N+B+IL_300C |
| $H_3PO_4$ pickling + IL-300° C. treatment | P+IL_300C |
| $H_3PO_4$ pickling + NaOH conditioning + IL-300° C. treatment | P+B+IL_300C |
| IL-RT 24-hr treatment (No pretreatment) | IL_RT |
| $H_3PO_4$ pickling + IL-RT treatment | P+IL_RT |

The methods used for surface characterization and electrochemical evaluation were similar to those in the Example 4. To investigate the effect of corrosive solution on the IL conversion film, the best-performing surface (P+IL_300C) was exposed to 1 wt. % NaCl saturated with $Mg(OH)_2$ for 4 hours. XPS analysis was conducted on this sample before and after the exposure to the corrosive solution.

Figure 6:
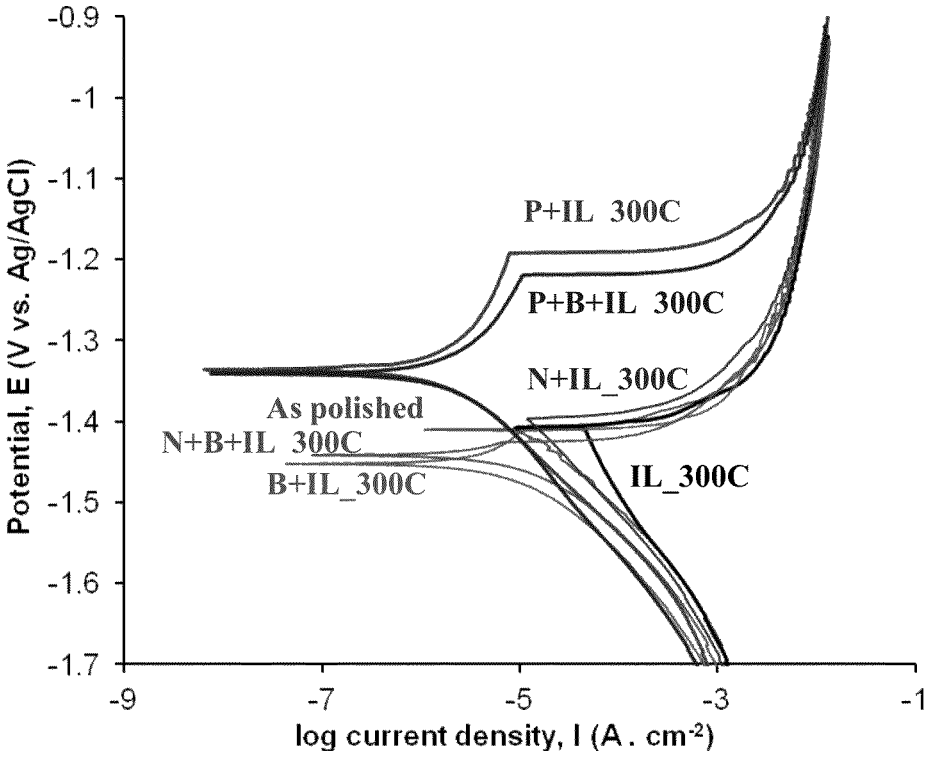
FIG. 6. Comparison of potentiodynamic polarization curves of untreated AZ31B Mg alloy and AZ31B Mg alloy treated with the ionic liquid [N8888][DEHP] at 300° C. with various pretreatments. The polarization curves were generated in a solution of 1 wt. % NaCl saturated with $Mg(OH)_2$ at room temperature. The purpose of this experiment was to determine the effects of pretreatment, with phosphoric acid pickling showing the best performance.

FIG. 6 shows potentiodynamic polarization curves of AZ31B Mg alloy treated with ionic liquid at 300° C., after treatment in 1 wt. % NaCl saturated with $Mg(OH)_2$. It can be seen that the pretreatment process may have a significant effect on the corrosion protection performance of the IL conversion film. For example, the sample pickled with phosphoric acid (P+IL_300C or P+B+IL_300C) showed significantly improved barrier property (i.e. increased polarization potential with almost constant anodic current) compared with the sample coated without pretreatment (IL_300C). Such barrier property indicates that the IL conversion film formed on these two samples is compact, continuous, and adherent to the substrate surface, and thus, could resist the attack of chloride ions during the anodic polarization process. In contrast, nitric acid pickling and conditioning had much less effect.

Figure 7:
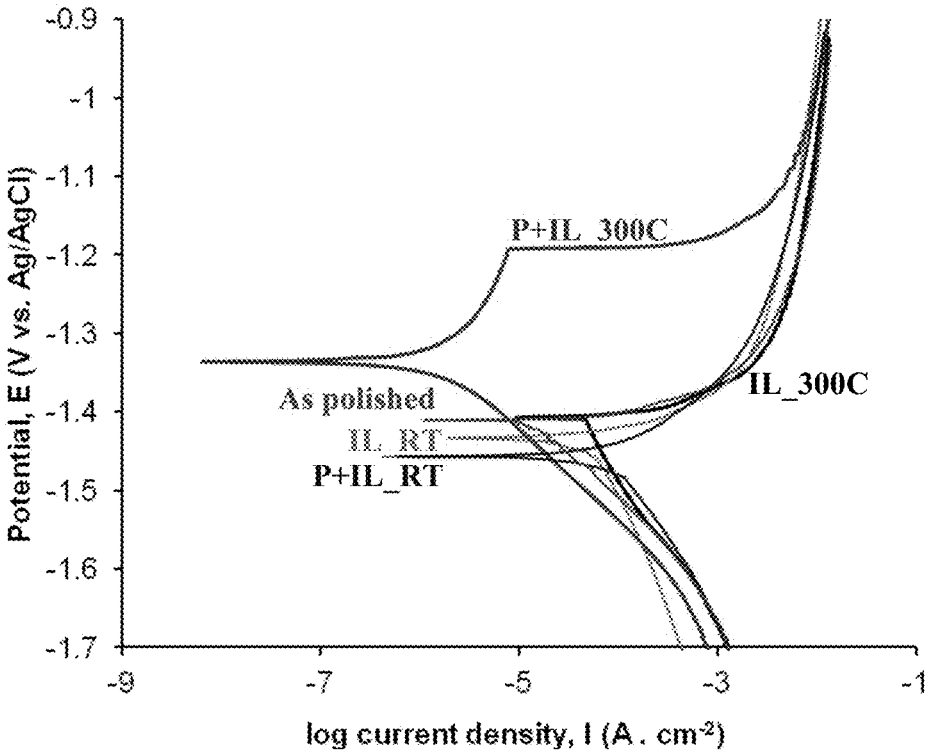
FIG. 7. Comparison of potentiodynamic polarization curves of AZ31B Mg alloy treated with the ionic liquid [N8888][DEHP] at 300° C. and room temperature (RT). Measurements were conducted in 1 wt. % NaCl saturated with $Mg(OH)_2$ at RT. The results show higher corrosion resistance of the conversion coating (film) generated at 300° C. as compared to the same surface treated with the ionic liquid at RT.

To further elucidate the synergy between the IL treatment at 300° C. and pretreatment, electrochemical results were benchmarked against those of the samples treated with the IL at RT, as shown in FIG. 7. The IL treatment at RT showed no measurable improvement in corrosion resistance even though the treatment duration was long (24 hrs), and pretreatment had little effect. The significant difference in anodic polarization currents between the P+IL_300C and P+IL_RT samples suggests a crucial role of the combination of phosphoric acid pickling and high temperature IL treatment in enhancing the corrosion resistance.

Important corrosion parameters deduced from polarization curves shown in FIGS. 6 and 7 are summarized in Table 3 below. As shown in Table 3, P+IL_300C and P+B+IL_300C exhibited the highest $R_p$ and $E_{pit}$ values among all tested samples. Moreover, those two samples showed more positive $E_{corr}$ than the other samples, indicating a higher resistance to corrosion.

TABLE 3

Electrochemical corrosion parameters deduced from polarization curves presented in FIGS. 6 and 7.

| Sample | $E_{corr}$ (V) | $R_p$ (kΩ cm^2) | $E_{pit}$, (V) |
|---|---|---|---|
| As polished | −1.411 | 0.148 | NA |
| IL_300C | −1.407 | 0.069 | NA |
| B+IL_300C | −1.453 | 2.732 | −1.411 |
| N+IL+_300C | −1.396 | 0.106 | NA |
| N+B+IL_300C | −1.442 | 0.673 | −1.425 |
| P+IL_300C | −1.335 | 13.226 | −1.191 |
| P+B+IL_300C | −1.341 | 10.638 | −1.219 |
| IL_RT | −1.433 | 0.183 | NA |
| P+IL_RT | −1.457 | 0.206 | NA |

$E_{corr}$: corrosion potential; $R_p$: polarization resistance; $E_{pit}$: pitting potential.

To establish a more fundamental understanding of the mechanism of IL/alloy interactions that provided the corrosion protection, XPS analyses were conducted on selected samples after the IL treatment but before corrosion testing. XPS was also conducted on the best performing P+IL_300C after a four-hour exposure to the chloride-containing solution (1 wt. % NaCl sat. with $Mg(OH)_2$). This latter sample is referred to as "P+IL_300C_corr".

Table 4 shows XPS survey data for the IL-coated samples at 300° C. taken on the surface immediately after a 10 second Ar-ion sputter etching. This short etching was performed to remove any contaminations adsorbed on the surface. The data in Table 4 indicates high oxygen content in the surface layer on all investigated samples, and this suggests substantial oxidation during the coating process. The phosphorus content on IL_300C and B+IL_300C appears to originate solely from the IL treatment, while the phosphorus content on P+B+IL_300C and P+IL_300C appears to be in part contributed by the phosphoric acid pickling as well. The decreased phosphorus content on the P+IL_300C surface after the corrosion test implies that the conversion coating actively interacted with the salt solution and part of the coating was dissolved in the corrosion process. The unexpected Si content on the P+IL_300C_corr may be introduced by impurities in the salt (NaCl).

TABLE 4

Surface composition (at. %) taken after 10 sec Ar-ion sputter etching (survey scan)

| | Mg | Al | Zn | O | C | P | N | Mn | Si |
|---|---|---|---|---|---|---|---|---|---|
| IL_300C | 21.3 | 0.5 | 0.0 | 31.0 | 44.4 | 1.2 | 0.8 | 0.0 | 0.0 |
| B + IL_300C | 27.0 | 1.0 | 0.0 | 39.3 | 29.4 | 2.4 | 0.5 | 0.0 | 0.2 |

TABLE 4-continued

Surface composition (at. %) taken after 10 sec Ar-ion sputter etching (survey scan)

| | Mg | Al | Zn | O | C | P | N | Mn | Si |
|---|---|---|---|---|---|---|---|---|---|
| P + B + IL_300C | 23.8 | 4.1 | 2.8 | 43.8 | 20.3 | 3.6 | 0.5 | 1.0 | 0.0 |
| P + IL_300C | 21.6 | 3.0 | 1.2 | 41.9 | 24.6 | 6.0 | 0.5 | 0.0 | 0.0 |
| P + IL_300C_corr | 25.2 | 3.3 | 0.5 | 49.5 | 15.3 | 2.4 | 0.3 | 0.0 | 3.4 |

Figure 8:
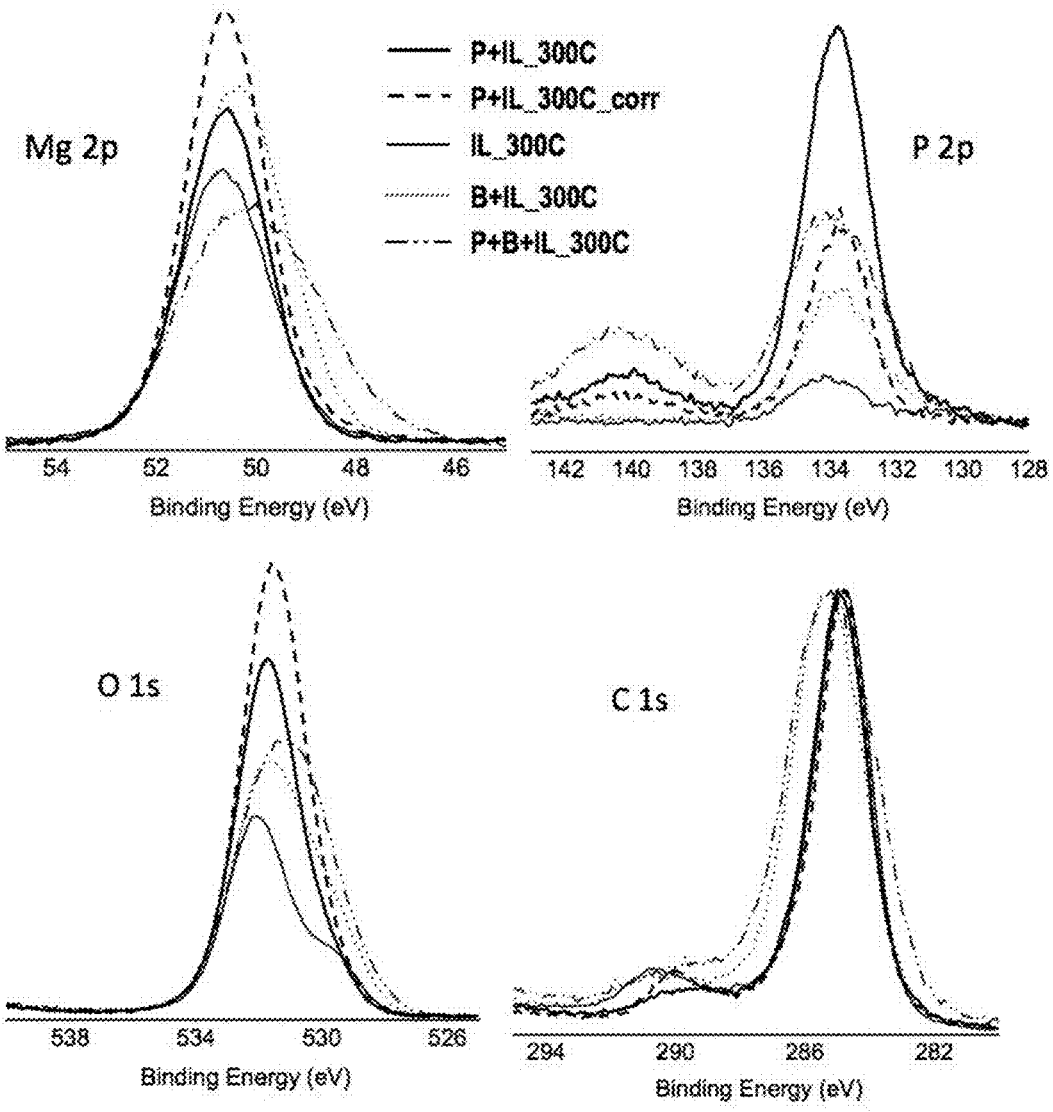
FIG. 8. XPS core level spectra of Mg (2p), P (2p), O (1s), and C (1s) for the [N8888][DEHP]-treated AZ31B surfaces without or with different pre-treatments. Results suggest that the IL conversion coatings are composed of metal phosphates, oxides, and carbonaceous compounds.

The XPS core level spectra of Mg, P, O, and C are shown in FIG. 8. The peak heights of P 2p spectra correlate very well with the P concentrations in Table 4, once again suggesting highest P content in the surface coating P+IL_300C. Although there are slight variations of the binding energy position of the peak maximum, the general binding energy of P 2p is in the range of 133-134 eV indicating P—O bonding. A small peak at ~140 eV suggests the existence of zinc phosphate. The metallic elements Mg, Al, and Zn are all dominantly present in ionic phases, presumably oxides and phosphates. The C 1 s shows at least three types of C-bonding: C—C at 284.8 eV, C—O at 285-286 eV, and carbonate (or some other O—C═O type of carbon species) at ~290 eV. The O is data show a mix of O species that can be related to metal-oxide (Mg—O; Al—O; Zn—O), P—O, and C—O bondings. The P+IL_300C_corr XPS spectra show little change in the surface composition except a reduced P content after four-hour immersion in NaCl solution. This confirms the protectiveness and robustness of the P+IL_300C conversion coating as previously shown by the electrochemical evaluation in FIG. 6.

Figure 9A:
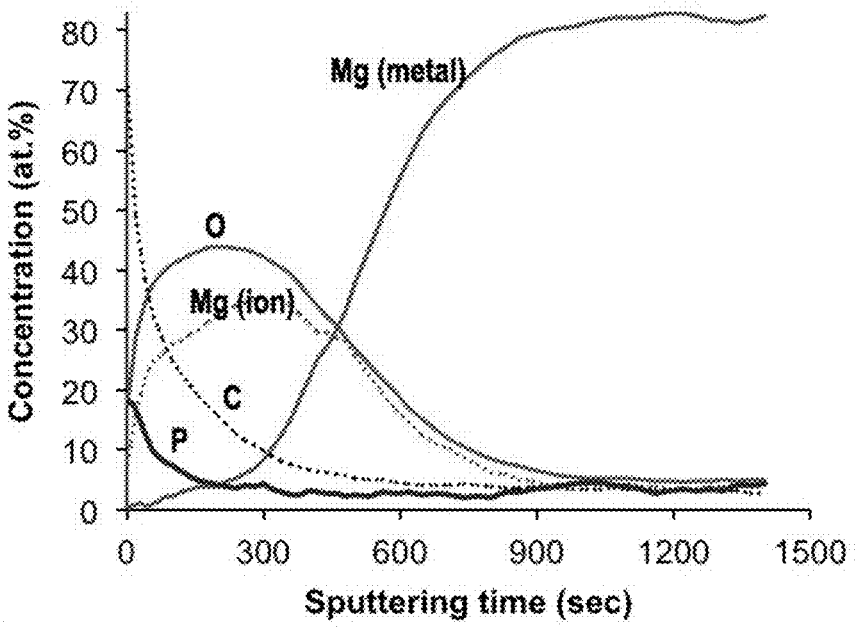
FIGS. 9A, 9B. XPS composition-depth profile of the surface of AZ31B magnesium alloy treated with the ionic liquid [N8888][DEHP] at 300° C. without pretreatment, with FIGS. 9A and 9B plotting the elements of high and low concentrations, respectively.
Figure 9B:
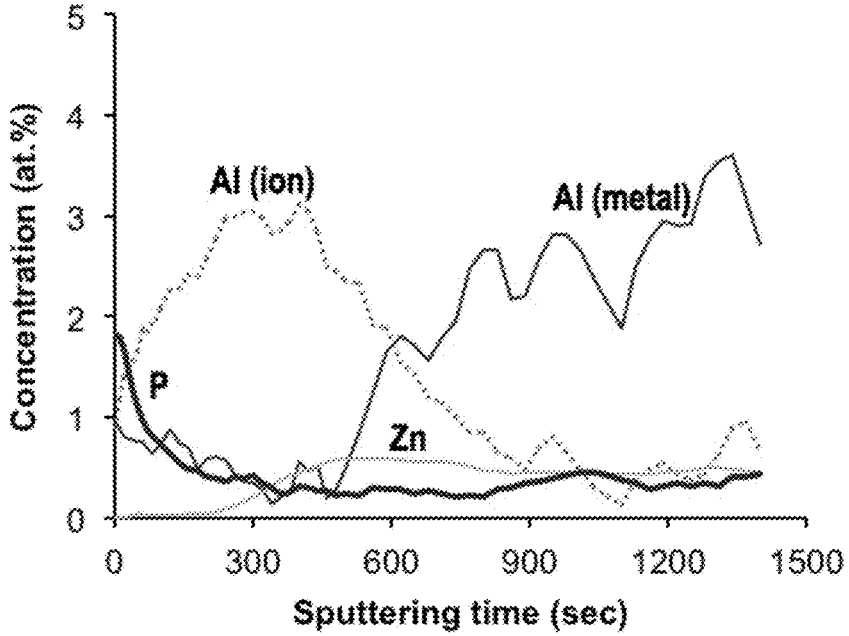

Aided by ion-sputtering, XPS composition-depth profiles were generated for the IL_300C, P+IL_300C, and P+IL_300C_corr surfaces. FIGS. 9A and 9B show the XPS composition-depth profile of the IL_300C surface. The top layer (<300 sec of sputtering) is composed of metal oxides and phosphates and some carbonaceous compounds. The phosphorus content indicates that the IL phosphate anion was actively involved in the conversion film formation. In contrast, as there was no detectable nitrogen, the role of the ammonium cation is not clear. As the outer layer is removed, the metal signals start increasing (from the exposed area of the metal substrate) and reach their highest plateaus around 900 seconds of sputtering. Since the surface of the IL_300C sample is relatively smooth, the roughness shadowing effect could be neglected and the average sputtering time for removing the conversion coating would be about 600 seconds. The maximum crater depth created by the 1400 seconds sputtering was determined to be about 520 nm using an optical profiler. If assuming a constant sputtering rate throughout the sputtering process, the mean thickness of the IL_300C conversion coating may be roughly estimated to be about 220 nm.

Figure 10A:
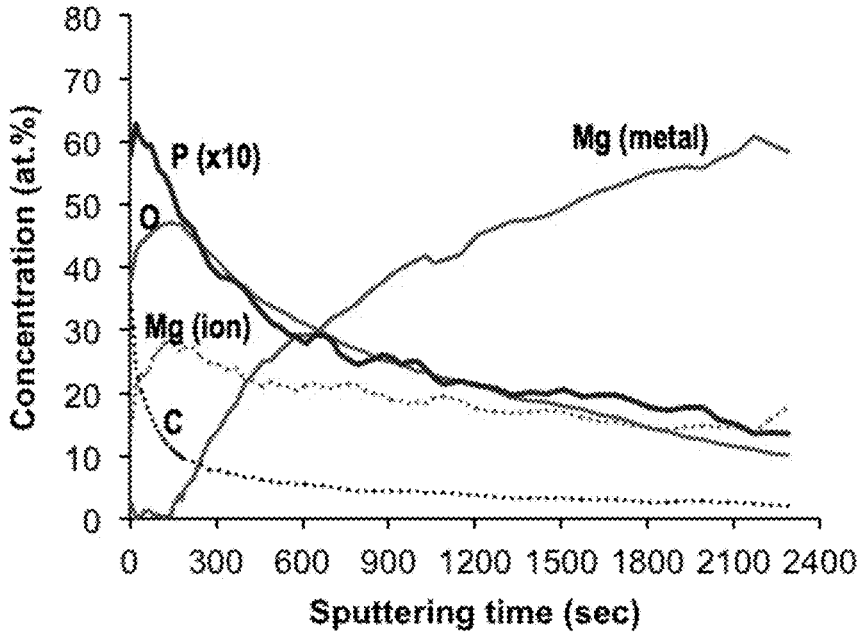
FIGS. 10A, 10B. XPS composition-depth profile of the surface of AZ31B magnesium alloy treated with phosphoric acid pickling pretreatment at RT and then with the ionic liquid [N8888][DEHP] at 300° C., with FIGS. 10A and 10B plotting the elements of high and low concentrations, respectively.
Figure 10B:
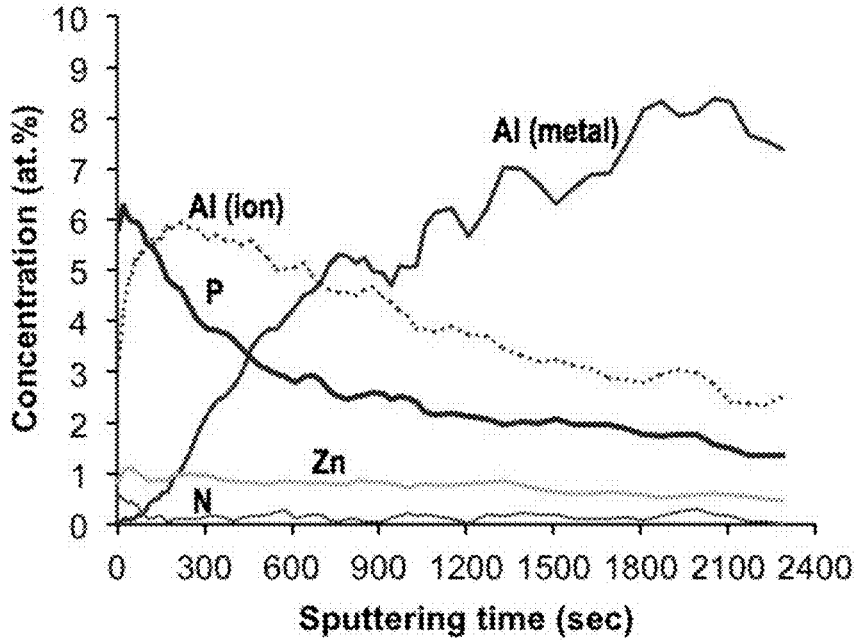

FIGS. 10A and 10B show the XPS composition-depth profile of the P+IL_300C surface. Compared to the IL_300C data, the most notable change is the higher phosphorus content, increased from less than 2 at. % to more than 6 at. % at the top surface. This agrees well with the survey scan results shown in Table 4. Similarly, no evidence was observed for the involvement of the IL cation in the coating process. A thicker conversion coating on the pickling-activated surface (P+IL_300C) was expected, but the much longer sputtering time cannot be proportionally translated to an increased film thickness because the pickled rougher surface made the shadowing effect much more significant in the ion sputtering.

The XPS composition-depth profile of the P+IL_300C_corr surface showed slightly higher oxygen concentration and longer sputtering time to remove the non-metallic surface layer imply growing surface oxides when attacked by CF ions in the salt solution. The phosphorus content (~2 at. %) appeared lower at the top layer than that (~6 at. %) of the surface before corrosion. This was caused by the interactions, chemically reacting and physically dissolving, between the IL conversion coating and the salt solution. It is significant that the bulk of the surface film maintained >2 at. % phosphorus even after the four-hour aggressive corrosion test, which suggests good corrosion inhibition for the IL conversion coating.

Results of electrochemical corrosion evaluations and XPS surface chemical analyses show strong anti-corrosion characteristics for the P+IL_300C conversion coating. The combination of phosphoric acid pickling and elevated temperature (300° C.) IL treatment showed an unexpected favorable synergy.

While there have been shown and described what are at present considered the preferred embodiments of the invention, those skilled in the art may make various changes and modifications which remain within the scope of the invention defined by the appended claims.

What is claimed is:

1. A method for conversion coating a magnesium-containing surface, the method comprising contacting the magnesium-containing surface with an ionic liquid compound under conditions that result in decomposition of the ionic liquid compound to produce a conversion coated magnesium-containing surface having a substantially improved corrosion resistance relative to the magnesium-containing surface before said conversion coating, wherein said decomposition results in breakage of one or more covalent bonds in a cationic or anionic component of the ionic liquid, wherein said conditions comprise tribological treatment of the magnesium-containing surface during contact of the magnesium-containing surface with said ionic liquid compound.

2. The method of claim 1, wherein said conditions further comprise heating said ionic liquid compound to a temperature at which the ionic liquid compound decomposes.

3. The method of claim 2, wherein said temperature is at least 100° C.

4. The method of claim 2, wherein said temperature is at least 150° C.

5. The method of claim 2, wherein said temperature is at least 200° C.

6. The method of claim 1, wherein said conditions further comprise heating said ionic liquid compound to a temperature of at least 80° C. at which the ionic liquid compound decomposes.

7. The method of claim 1, wherein said tribological treatment comprises polishing of the magnesium-containing surface.

8. The method of claim 1, further comprising subjecting the magnesium-containing surface to an acid pickling step prior to contacting the magnesium-containing surface with an ionic liquid compound under conditions that result in decomposition of the ionic liquid compound.

9. The method of claim 8, further comprising subjecting the magnesium-containing surface to an alkaline conditioning step after said acid pickling step and prior to contacting the magnesium-containing surface with an ionic liquid compound under conditions that result in decomposition of the ionic liquid compound.

10. The method of claim 1, wherein said ionic liquid compound has the general formula:

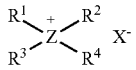

(1)

wherein:

Z is either N or P;

$X^-$ is an anionic component of the ionic liquid; and $R^1$, $R^2$, $R^3$, and $R^4$ are each independently selected from hydrogen atom and hydrocarbon groups having at least one and up to twenty carbon atoms, wherein said hydrocarbon group is optionally substituted with one or more heteroatoms selected from fluorine, nitrogen, oxygen, and sulfur, and wherein, optionally, two or more of $R^1$, $R^2$, $R^3$, and $R^4$ may be combined to form one or more cyclic groups that includes Z as a ring heteroatom, or two of $R^1$, $R^2$, $R^3$, and $R^4$ may be combined to form a group linked to Z by a double bond;

provided that at least one of $R^1$, $R^2$, $R^3$, and $R^4$ is a hydrocarbon group, and further provided that $R^1$, $R^2$, $R^3$, and $R^4$ are all hydrocarbon groups when Z is P.

11. The method of claim 10, wherein said ionic liquid compound has the general formula:

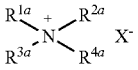

wherein $R^{1a}$, $R^{2a}$, $R^{3a}$, and $R^{4a}$ are each independently selected from hydrogen atom and hydrocarbon groups having at least one and up to twenty carbon atoms, wherein the hydrocarbon groups are optionally substituted with one or more fluorine atoms, provided that at least one of $R^{1a}$, $R^{2a}$, $R^{3a}$, and $R^{4a}$ is a hydrocarbon group.

12. The method of claim 11, wherein at least one of $R^{1a}$, $R^{2a}$, $R^{3a}$, and $R^{4a}$ is selected from said hydrocarbon groups.

13. The method of claim 11, wherein at least two of $R^{1a}$, $R^{2a}$, $R^{3a}$, and $R^{4a}$ are selected from said hydrocarbon groups.

14. The method of claim 11, wherein at least three of $R^{1a}$, $R^{2a}$, $R^{3a}$, and $R^{4a}$ are selected from said hydrocarbon groups.

15. The method of claim 11, wherein all of $R^{1a}$, $R^{2a}$, $R^{3a}$, and $R^{4a}$ are selected from said hydrocarbon groups.

16. The method of claim 11, wherein at least one of $R^{1a}$, $R^{2a}$, $R^{3a}$, and $R^{4a}$ is a straight-chained or branched alkyl group having at least four carbon atoms and optionally substituted with one or more fluorine atoms.

17. The method of claim 11, wherein at least one of $R^{1a}$, $R^{2a}$, $R^{3a}$, and $R^{4a}$ is a straight-chained or branched alkyl group having at least six carbon atoms and optionally substituted with one or more fluorine atoms.

18. The method of claim 10, wherein said ionic liquid compound has the general formula:

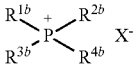

wherein $R^{1b}$, $R^{2b}$, $R^{3b}$, and $R^{4b}$ are independently selected from hydrocarbon groups having at least one and up to twenty carbon atoms, wherein the hydrocarbon groups are optionally substituted with one or more fluorine atoms.

19. The method of claim 18, wherein at least one of $R^{1b}$, $R^{2b}$, $R^{3b}$, and $R^{4b}$ is a straight-chained or branched alkyl group having at least four carbon atoms and optionally substituted with one or more fluorine atoms.

20. The method of claim 18, wherein at least one of $R^{1b}$, $R^{2b}$, $R^{3b}$, and $R^{4b}$ is a straight-chained or branched alkyl group having at least six carbon atoms and optionally substituted with one or more fluorine atoms.

21. The method of claim 10, wherein $X^-$ is a phosphorus-containing anion.

22. The method of claim 21, wherein said phosphorus-containing anion has the formula:

(2)

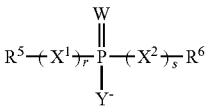

wherein $R^5$ and $R^6$ are independently selected from hydrocarbon groups having at least one and up to twenty carbon atoms, wherein the hydrocarbon groups are optionally substituted with one or more fluorine atoms, and $R^5$ and $R^6$ may optionally interconnect to form a ring; $X^1$, $X^2$, W, and Y are independently selected from O and S atoms; and subscripts r and s are independently selected from 0 and 1.

23. The method of claim 22, wherein said phosphorus-containing anion has the formula:

(2a)

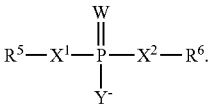

24. The method of claim 22, wherein said phosphorus-containing anion has the formula:

(2b)

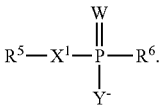

25. The method of claim 22, wherein said phosphorus-containing anion has the formula:

(2c)

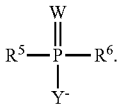

26. The method of claim 22, wherein said phosphorus-containing anion has the formula:

(3)

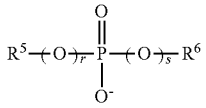

wherein $R^5$ and $R^6$ are independently selected from hydrocarbon groups having at least one and up to twenty carbon atoms, wherein the hydrocarbon groups are optionally substituted with one or more fluorine atoms, and $R^5$ and $R^6$ may optionally interconnect to form a ring; and subscripts r and s are independently selected from 0 and 1.

27. The method of claim 26, wherein said phosphorus-containing anion is an organophosphate anion of the formula:

(3a)

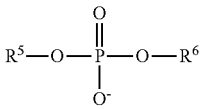

wherein $R^5$ and $R^6$ are independently selected from hydrocarbon groups having at least one and up to twenty carbon atoms, wherein the hydrocarbon groups are optionally substituted with one or more fluorine atoms.

28. The method of claim 26, wherein said phosphorus-containing anion is an organophosphonate anion of the formula:

(3d)

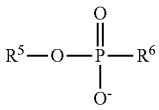

wherein $R^5$ and $R^6$ are independently selected from hydrocarbon groups having at least one and up to twenty carbon atoms, wherein the hydrocarbon groups are optionally substituted with one or more fluorine atoms.

29. The method of claim 26, wherein said phosphorus-containing anion is an organophosphinate anion of the formula:

(3g)

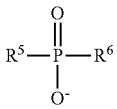

wherein $R^5$ and $R^6$ are independently selected from hydrocarbon groups having at least one and up to twenty carbon atoms, wherein the hydrocarbon groups are optionally substituted with one or more fluorine atoms.

30. The method of claim 22, wherein said hydrocarbon groups are selected from straight-chained and branched alkyl groups having at least four carbon atoms.

31. The method of claim 22, wherein said hydrocarbon groups are selected from straight-chained and branched alkyl groups having at least five carbon atoms.

32. The method of claim 22, wherein said hydrocarbon groups are selected from straight-chained and branched alkyl groups having at least six carbon atoms.

* * * * *